US008152202B2

(12) United States Patent
Horn

(10) Patent No.: US 8,152,202 B2
(45) Date of Patent: Apr. 10, 2012

(54) SPINE ELEMENTS FOR USE WITH ALBUMS

(76) Inventor: Hans Johann Horn, Bern (CH)

( * ) Notice: Subject to any disclaimer, the term of this patent is extended or adjusted under 35 U.S.C. 154(b) by 663 days.

(21) Appl. No.: 12/238,110

(22) Filed: Sep. 25, 2008

(65) Prior Publication Data

US 2009/0121468 A1 May 14, 2009

(30) Foreign Application Priority Data

Sep. 26, 2007 (DE) ..... 10 2007 046 195

(51) Int. Cl.
*B42D 1/00* (2006.01)

(52) U.S. Cl. ..... 281/28; 281/21.1

(58) Field of Classification Search ..... 281/28, 281/21.1, 23

See application file for complete search history.

(56) References Cited

U.S. PATENT DOCUMENTS 219,582 A * 9/1879 Holmes ..... 281/23
1,792,740 A * 2/1931 Hayden ..... 402/63
1,806,057 A * 5/1931 Heer ..... 402/60
4,896,900 A * 1/1990 Hong ..... 281/15.1
5,104,147 A * 4/1992 King ..... 281/21.1
5,626,367 A * 5/1997 Lu ..... 281/21.1
5,636,869 A * 6/1997 Holmes ..... 281/45
5,765,872 A * 6/1998 Brugmann ..... 281/21.1
5,967,555 A * 10/1999 Samelian ..... 281/21.1
5,975,577 A * 11/1999 Gottdiener ..... 281/21.1
6,213,702 B1 * 4/2001 Wesselink ..... 412/1
6,736,563 B1 * 5/2004 With ..... 402/60
2009/0079179 A1 * 3/2009 Goodfellow et al. ..... 281/21.1

* cited by examiner

*Primary Examiner* — Joanne Silbermann
*Assistant Examiner* — Christopher e Veraa
(74) *Attorney, Agent, or Firm* — Hanley, Flight & Zimmerman, LLC

(57) ABSTRACT

Spine elements for use with albums are described. An example album includes a first spine element and a second spine element that is substantially similar to the first spine element. The first spine element is adjacent and removably coupled to the second spine element to form an album spine. Additionally, the first spine element and the second spine element each include a binding gap positioned toward the interior of the album to receive and couple an edge of at least one album sheet to the respective spine element.

30 Claims, 18 Drawing Sheets

A
A
18
50
26
28
22
602
604

46'
46''
44'
44''
18
704
50

46'
46''
44'
18
50

46'
46''
44'
44'
18
702
50

22
50
48''
44''
18
42''
40''
18
50

800
802
10
12'
14
16
18
30''
32
34
36'
36''
48''
50

12'
18
58
36''

12'
62
36'
18

12'
18
62

1002
60
62

12'
62
1004
18

13
12'
54
24'
56
24

72
74
76
70

70
72
74
96
DETAIL D
18

C
C
12'
24'
18

70
64
18
26
28
70
64
D 64
28
64
18
12'
26
22, 24'

A
A
92
104
18'
102
64
80
66
68
78

SPINE ELEMENTS FOR USE WITH ALBUMS

RELATED APPLICATION

This patent claims the benefit of German Patent Application 10 2007 046 195.1, filed Sep. 26, 2007, which is hereby incorporated herein by reference in its entirety.

FIELD OF THE DISCLOSURE

This patent relates generally to spine elements and, more specifically, to spine elements for use with albums.

BACKGROUND

Known albums are available having variable content, in which album sheets can be inserted or removed. Some known albums are able to concurrently increase their size as additional album sheets are inserted into the album. Specifically, some known albums (e.g., post albums) are provided with extendable screws and variable-length bushing inserts onto which perforated album sheets may be affixed or hung. Different length extendable screws and/or bushings are utilized depending on the number of additional album sheets that are to be added. Thus, the width of the album spine can grow as pages are inserted. However, depending on the number of album sheets that are added once the additional extendable screw and/or bushing is added to known albums, the album sheets may be loose within the album. Additionally, known albums must concurrently telescopically grow to enable the album to properly close once a certain number of additional album sheets have been added and, thus, lateral edges of known album spines may be slightly inverted relative to the album.

Other known albums are provided with adjustable string-on straps arranged on and extending across the album spine or the album cover. Generally, these string-on straps concurrently telescopically extend as contents or pages are added to the album. Unfortunately, these string-on straps may not be esthetically pleasing and, thus, adjustable covering devices are typically added. Additionally, the album sheets must be removed from the strap to rearrange the order of the album sheets within the album. Specifically, to remove, rearrange and/or insert album sheets within the string-on strap album and/or the post album, all of the album sheets have to be individually removed from the strap or the extendable screws and/or bushings to, for example, insert an album sheet in a particular location within either of these albums and, thus, the holes of the album sheets have a tendency to tear.

DETAILED DESCRIPTION

Certain examples are shown in the above-identified figures and described in detail below. In describing these examples, like or identical reference numbers are used to identify the same or similar elements. The figures are not necessarily to scale and certain features and certain views of the figures may be shown exaggerated in scale or in schematic for clarity and/or conciseness. Additionally, several examples have been described throughout this specification. Any features from any example may be included with, a replacement for, or otherwise combined with other features from other examples.

The example albums described herein enable a consumer to vary the capacity of the album by a few hand movements without affecting the stability, handling, or closed appearance of the album. In particular, the example albums described herein are provided with a plurality of example spine elements that are removably coupled to each other to increase or decrease the size, that is, spine width, of the album. Each of the example spine elements are provided with a binding gap to receive a back edge or spine section of at least one album sheet, which decreases the likelihood that one of the album sheets will tear or be damaged during handling of the album.

The example apparatus described herein relate generally to albums having a spine and a plurality of album sheets removably coupled to the spine via a spine section that corresponds to each of the album sheets. The album sheets are positioned within the interior of album. In some examples, the spine includes a plurality of spine elements that are removably coupled to one another and/or to a cover element(s). Additionally, each of the spine elements is provided with a binding gap that receives the spine section of the album sheet(s). Each of the binding gaps of the spine elements is positioned toward the interior of the album. The example apparatus described herein enable consumers to easily attain an album having variable capacity and to remove, rearrange and/or insert spine elements within the album. Additionally, the rigidity of the spine elements enables the album to, for example, stand upright without substantially flexing or deforming.

Additionally, the example apparatus described herein relate to an album having a spine, and a plurality of album sheets coupled to the album spine. The plurality of album sheets are arranged within the album interior. The album may be utilized in any suitable setting and for any suitable use such as, for example, in a private domain (e.g., scrap booking, photo album, etc.) or in a business domain (e.g., to hold records, documents, for presentations, etc.).

Figures 1A, 1B:
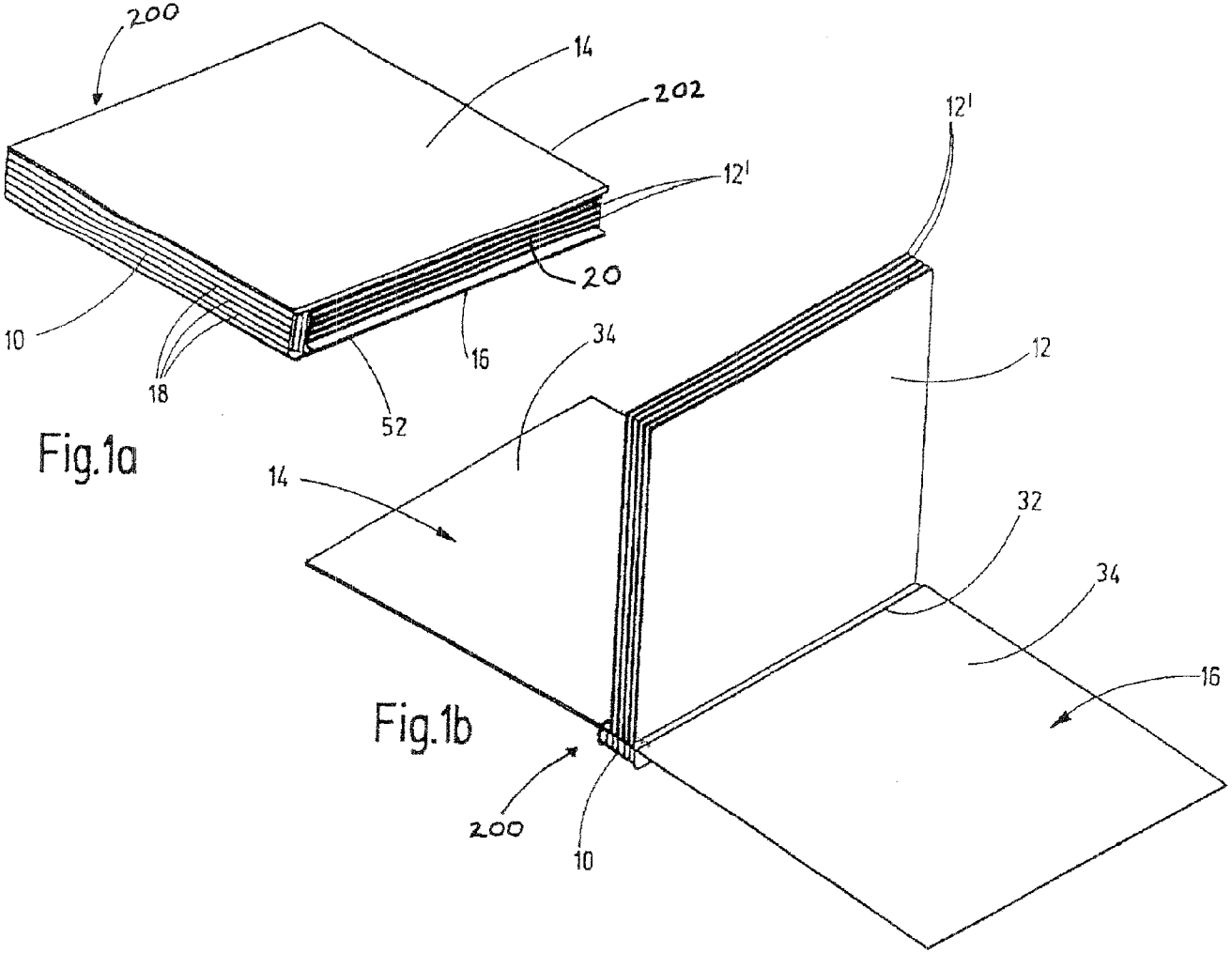
FIG. 1*a* depicts an example album having closed cover sections.
FIG. 1*b* depicts the example album of FIG. 1*a* having open cover sections.
Figure 4A:
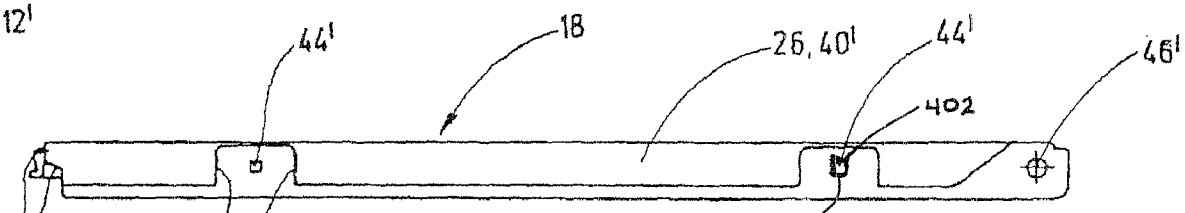
FIGS. 4*a*-4*c* depict different views of the example spine element having an example latching mechanism of FIG. 3.
Figure 4B:
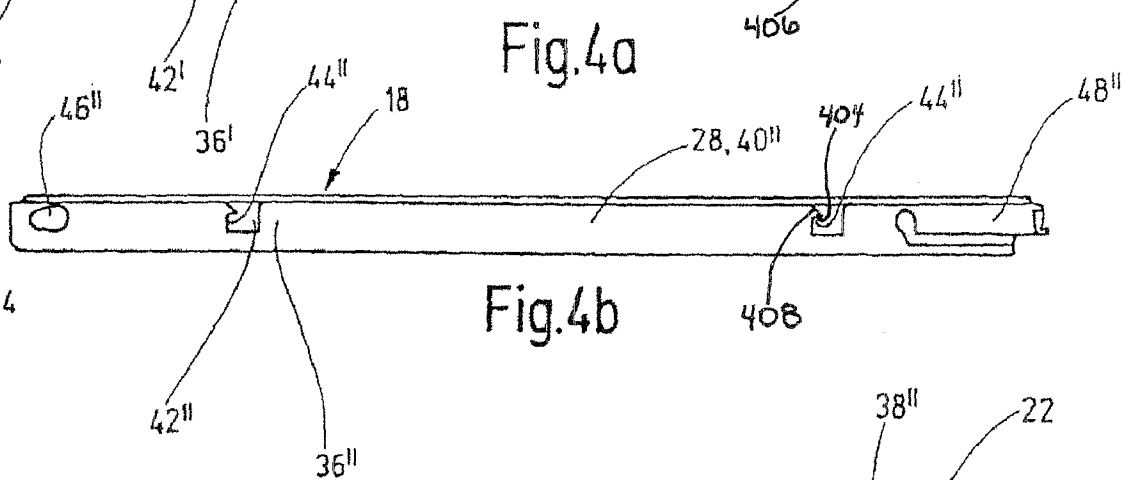
Figure 4D:
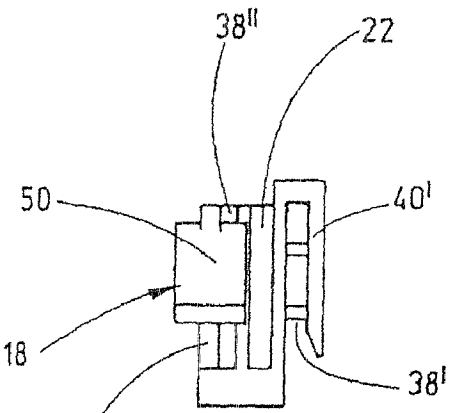
FIG. 4*d* depicts a front view of the example spine element of FIGS. 3 and 4*a*-4*c*.
Figure 4C:
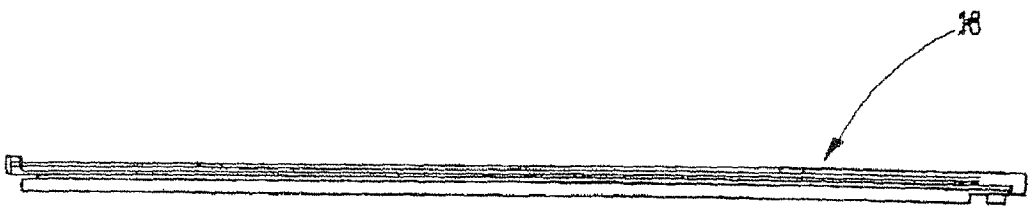
Figure 3:
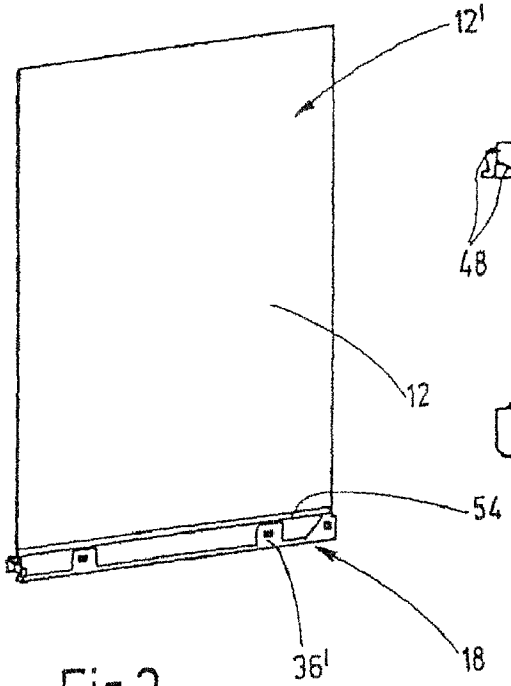
FIG. 3 depicts an example spine element and an example album insert that may be utilized to implement the example album of FIGS. 1*a* and 1*b*.
Figure 5B:
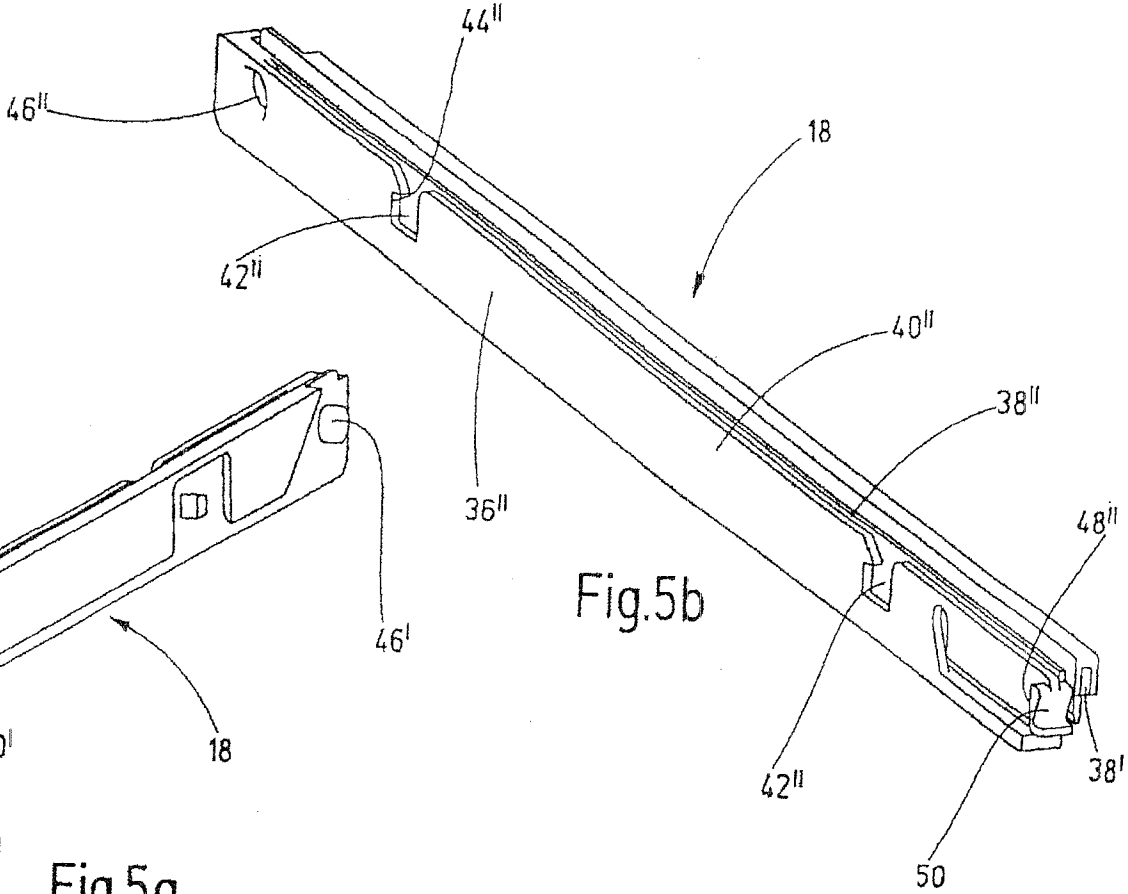
FIGS. 5*a* and 5*b* depict left and right trimetric views of example spine elements.
Figure 5A:
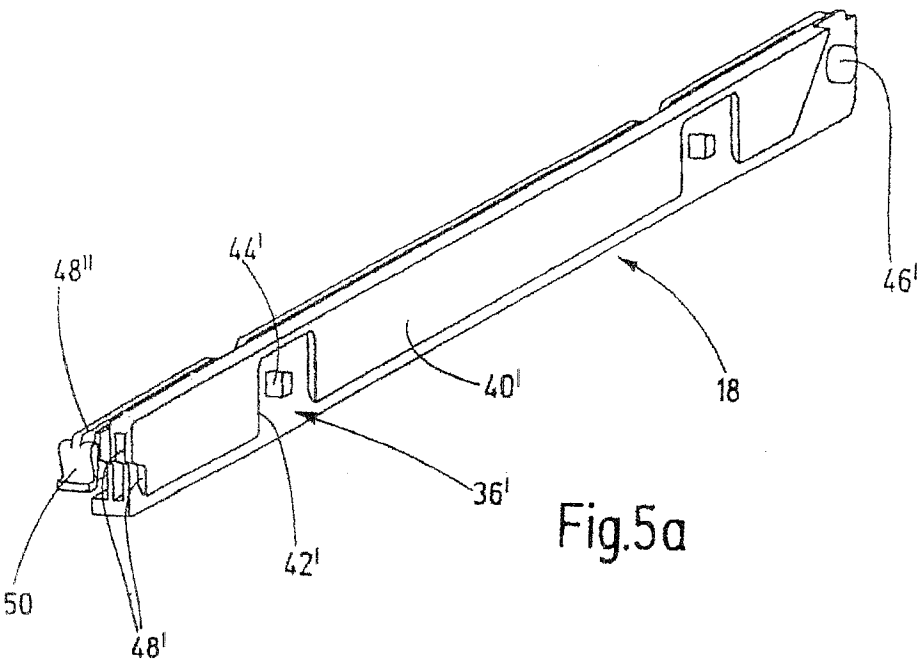

Turning to FIGS. 1*a* and 1*b*, an example album 200 includes an album spine 10, a plurality of album sheets 12, a front cover element 14, and a back cover element 16. The album spine 10 includes a plurality of spine elements 18 each having a binding gap 22 (see, for example, FIG. 4*d* or 6*e*) that is positioned toward an album interior 20. The binding gap 22 (see, for example, FIG. 6*e*) is to receive and affix a back edge 24 (see, for example, FIG. 10*f*) of at least one of the album sheets 12. In practice, a plurality of album sheets 12 can be assembled together into an album sheet insert 12', which can then be inserted into the binding gap 22 (see, for example, FIG. 6*e*). Specifically, the plurality of album sheets 12 that comprise the album sheet insert 12' are arranged in the same direction and, thus, the respective back edge 24 of each of the album sheets 12 can be inserted into the binding gap 22 (see, for example, FIG. 6*e*) of the particular spine element 18.

The spine elements 18 are detachably coupled to adjacent spine elements 18 (e.g., the spine element 18 to the left or to the right) to form the album spine 10 (e.g., a closed album spine). The spine element 18 may comprise a slat or a rod having a substantially rectangular cross-section. First and second lateral surfaces 26 and 28 (see, for example, FIG. 6*e*) of the spine element 18 are adjacent the respective lateral surfaces 26 and 28 of another spine element 18. For example, the first lateral surface 26 of a first spine element 602 (see, for example, FIG. 6*e*) is adjacent the second lateral surface 28 of a second spine element 604 (see, for example, FIG. 6*e*). In some examples, the spine elements 18 include a plastic material. However, the spine elements 18 may include any other suitable material. Typically, the album sheets 12 include a substantially flat material such as, for example, a paper material, a carton material, a cardboard material, or a plastic material (e.g., plastic sheeting). In other examples, the album sheets 12 may comprise a transparent pocket for receiving and/or accepting flat material objects. Alternatively, the album sheets 12 may comprise a piece or a swatch of a wallpaper material, or a carpet material. However, any other suitable material may be used to implement the album sheets 12. Generally, the example album 200 is used as a container to collect, present, show and/or store material (e.g., written material) and/or substantially flat objects.

As depicted in FIGS. 1*a* and 1*b*, the album 200 is contained between the cover elements 14 and 16. To removably couple the cover elements 14 and 16 to the adjacent spine element 18, the cover elements 14 and 16 are respectively provided with spine sections 30' and 30" (see, for example, FIGS. 2*a* and 2*b*). Additionally, the cover section 34 is provided with an articulation 32 (e.g., a movable joint or hinge) to enable the cover section 34 to be rotated (e.g., turned) once the cover section 34 is coupled to the spine section 30' and 30". Generally, the articulation 32 enables the cover elements 14 and 16, which may made of a relatively stiff or rigid material, to be folded from the closed position as depicted in FIG. 1*a* to the open position as depicted in FIG. 1*b*. In some example implementations, the articulation 32 may be located at a distance from an outside wall of the album spine 10, which corresponds to a width of the spine sections 30' and 30" (see, for example, FIGS. 2*a* and 2*b*). Alternatively, the position of the articulation 32 may be inverted such that the articulation 32 is arranged as depicted in FIGS. 11*a*-11*d*.

Figures 2A, 2B:
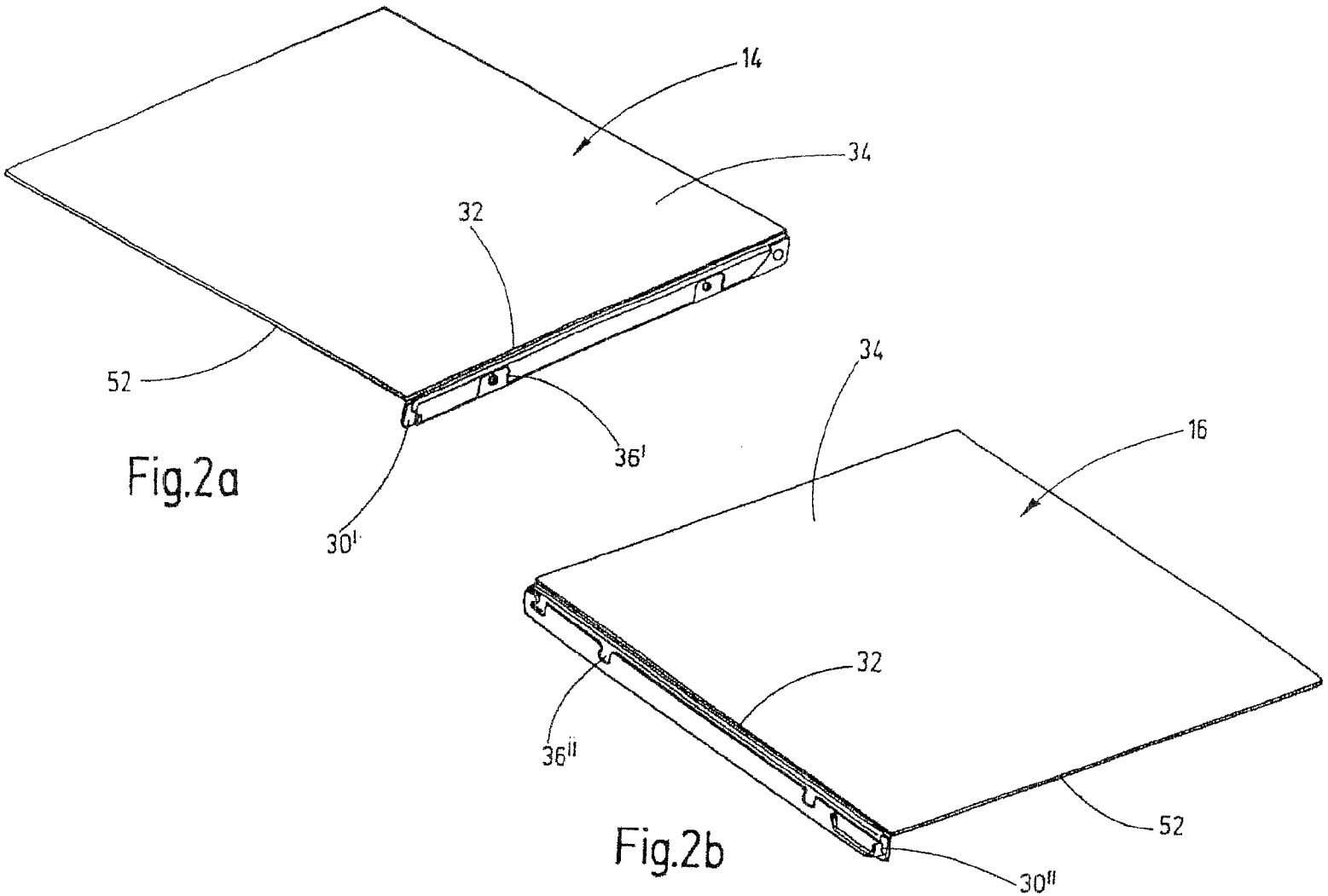
FIG. 2*a* depicts an example front cover that may be utilized to implement the example album of FIGS. 1*a* and 1*b*.
FIG. 2*b* depicts an example back cover that may be utilized to implement the example album of FIGS. 1*a* and 1*b*.

Referring to FIGS. 1-11, the spine elements 18 are provided with a latching mechanism 36 that includes two complementary first and second latching mechanism halves 36' and 36" (see, for example, FIGS. 2*a* and 2*b*). Specifically, each spine element 18 includes one of the latching mechanism halves 36' or 36" on the first lateral surface 26 and includes the other latching mechanism half 36' or 36" on the second lateral surface 28 (see, for example, FIGS. 4*a*, 4*b*, 5*a* and 5*b*). In contrast, the cover elements 14 and 16 include one of the latching mechanism halves 36' or 36" on the spine section 30' or 30". As such, the latching mechanism 36 enables the spine elements 18 to be removably coupled or interlatched in pairs and/or removably coupled or interlatched to one of the cover elements 14 or 16. Generally, the interaction between the latching mechanism halves 36' and 36" of the latching mechanism 36 provide a stable form fit both in the transverse direction and in the longitudinal direction for the spine elements 18 and/or the cover elements 14 and 16 and, thus, the spine elements 18 are substantially immovable relative to one another regardless of the number of spine elements 18 that comprise the album spine 10 to form a closed and stable album spine 10.

Turning to FIGS. 4*a*-4*d*, the form fit in the transverse direction is provided by lateral wall sections 40' and 40" that are adjacent the lateral surfaces 26 and 28. The lateral wall sections 40' and 40" define a slot 38' and 38" that enables the lateral wall sections 40' or 40" to reach behind the corresponding lateral wall section 40' or 40" and be inserted into the slot 38' or 38" in the transverse direction (e.g., compare FIGS. 4*d* and 6*e*). Generally, in the mounted state, the lateral wall section 40' or 40" and the slot 38' or 38" substantially interact in a spring-like manner. The lateral wall sections 40' and 40" define open-edge windows or openings 42' and 42" into which first and second latching devices 44' and 44" of a latching device 44 are positioned in the mounted state (e.g., two or more spine elements 18 removably coupled together). The openings 42' and 42" and the latching devices 44' and 44" are associated with either of the latching mechanism halves 36' and 36". In some examples, the first latching device 44' may be a quadrilateral shape (e.g., a polygon; a right-angled trapezium) that is provided with a tapered edge 402 that corresponds to a first tapered edge 404 of the second latching device 44". As discussed in more detail below, as the first spine element 602 (see, for example, FIG. 6*a*) is pivoted relative to the second spine element 604 (see, for example, FIG. 6*a*), at least a surface 406 (see, for example, FIG. 4*a*) of the first latching device 44' engages a second tapered surface 408 (see, for example, FIG. 4*b*) of the second latching device 44" prior to being positioned adjacent the first tapered surface 404 (see, for example, FIG. 4*b*). In practice, at least a portion of the lateral wall sections 40' and 40" are inserted into the corresponding slot 38' and 38", and the second latching device 44" of the second latching mechanism half 36" is a back edge (e.g., a back grip) of the opening 42". Additionally, to facilitate the connection between different spine elements 18, the first latching mechanism half 36' is provided with a protrusion or a positioning peg 46' (see, for example, FIG. 4*a*) that corresponds to an elongated recess 46" (see, for example, FIG. 4*b*) defined by the second latching mechanism half 36". Opposite the positioning peg 46' is a step 48' that, in the mounted state, interacts with a biasing element 48" that is opposite the elongated recess 46". The step 48' and the biasing element 48" comprise connecting elements 48. Specifically, the biasing element 48" reaches around the step 48' and exerts a force on the spine elements 18 to maintain the position of the spine elements 18 relative to one another and to position the positioning peg 46' toward the rear of the elongated recess 46".

Figures 5C, 6A, 6B, 6C, 6D, 6E:
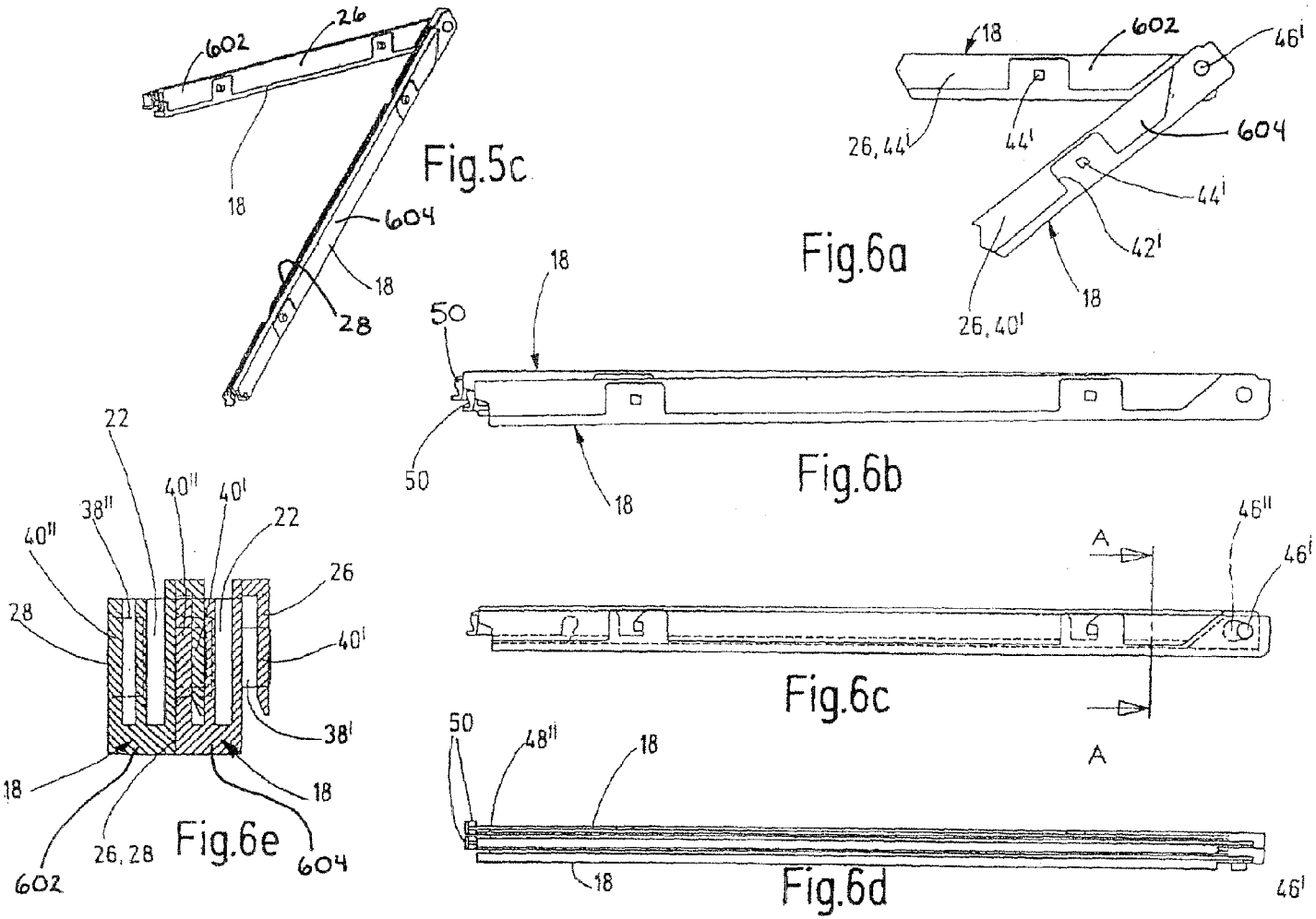
FIG. 5*c* depicts two example spine elements of FIGS. 5*a* and 5*b* to be joined to on another, but oriented in a starting position.
FIGS. 6*a*-6*c* depict the two example spine elements in a starting position, an intermediate position, and a latched position, respectively, to demonstrate the latching process.
FIG. 6*d* depicts a top view of the two example spine elements in the latched position of FIG. 6*c*.
FIG. 6*e* depicts a cross section of the two example spine elements along line A-A of FIG. 6*c*.
Figures 7A, 7B, 7C, 7D:
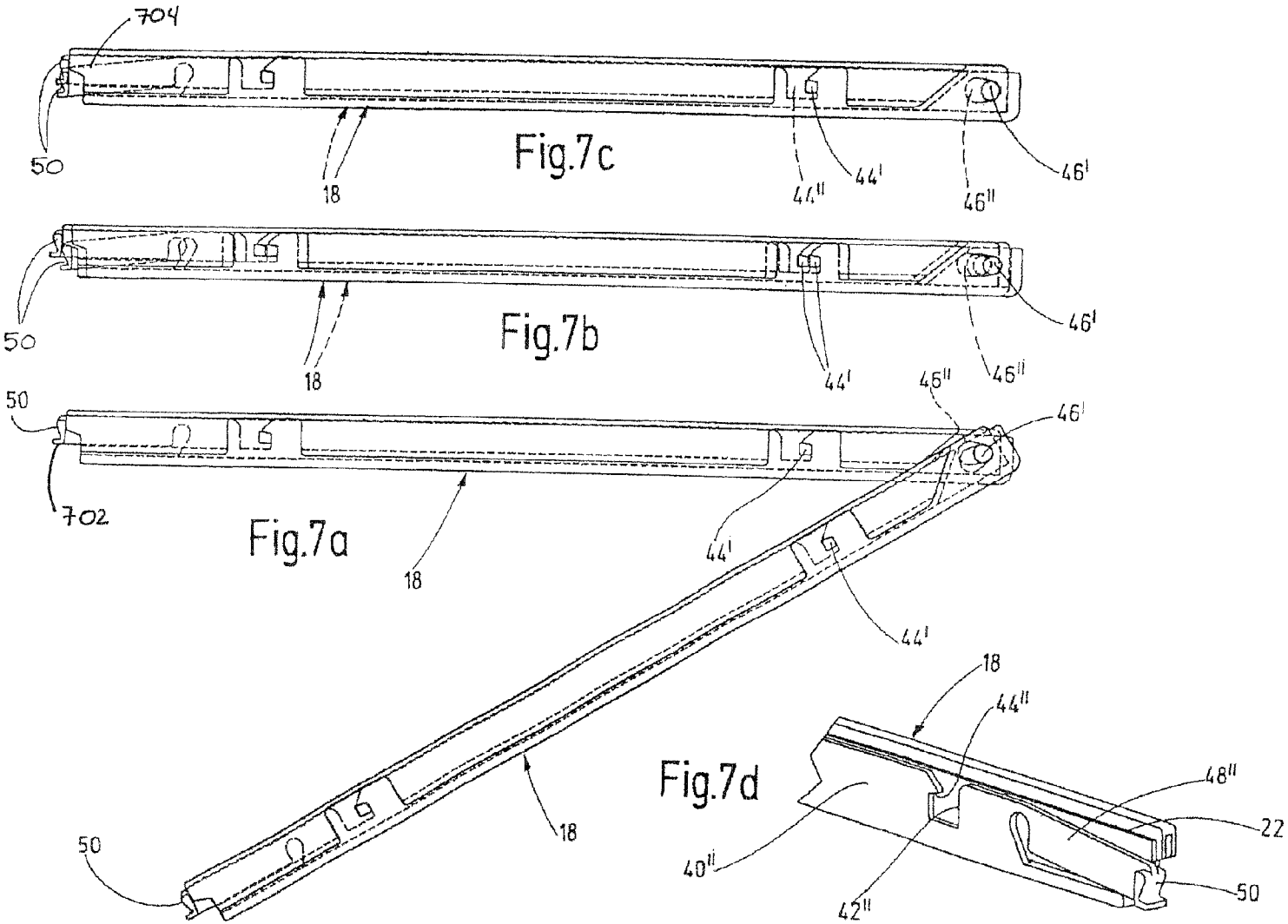
FIGS. 7*a*-7*c* depict a detailed view of the example spine elements in positions similar to the positions of FIGS. 6*a*-6*c*, but showing in dashed form hidden lines showing relative positions of features of the example spine elements during the latching process.
FIG. 7*d* depicts an example spine element having an example biasing element in a depressed position.

Turning now to FIGS. 6*a*-6*c* and 7*a*-7*c*, in practice, initially, the first lateral surface 26 of the first spine element 602 (see, for example, FIG. 6*a*) is positioned toward the second lateral surface 28 of the second spine element 604 (see, for example, FIG. 6*a*). The first spine element 602 is held at approximately a 30 degree angle relative to the second spine element 604 (see, for example, FIGS. 5*c*, 6*a* and 7*a*) and then the positioning peg 46' of the first spine element 602 is inserted into the elongated recess 46" defined by the second spine element 604. The first and second spine elements 602 and 604 are then pivoted toward each other relative to an axis of the positioning peg 46' such that the lateral wall sections 40' and 40" are inserted into and/or penetrate the corresponding slots 38" and 38'. The position of the lateral wall sections 40' and 40" relative to the slots 38" and 38' substantially maintains the position of the first spine element 602 relative to the second spine element 604 in at least one spatial direction (e.g., x-axis, y-axis or z-axis). The first and second spine elements 602 and 604 are moved to be substantially parallel relative to one another. Specifically, the first and second spine elements 602 and 604 are moved until the second latching device 44" engages the first latching device 44' and the biasing element 48" engages the step 48' as depicted in FIG. 7*b* and, thus, the first and the second spine elements 602 and 604 become latched together (e.g., removably coupled) as depicted in FIG. 7*c*.

The interaction between the latching devices 44' and 44" maintains the position of the first spine element 602 relative to the second spine element 604 in at least one spatial direction (e.g., x-axis, y-axis or z-axis). Additionally, the interaction between the positioning peg 46' and the elongated recess 46 and the interaction between the step 48' and the biasing element 48" maintains the position of the first spine element 602 relative to the second spine element 604 in at least one spatial direction (e.g., x-axis, y-axis or z-axis). For example, the position of the lateral wall sections 40' and 40" relative to the slots 38" and 38' may maintain the position (e.g., substantially prevent movement) of the first spine element 602 relative to the second spine element 604 in a first spatial direction (e.g., x-axis); the interaction between the latching devices 44' and 44" may maintain the position of the first spine element 602 relative to the second spine element 604 in a second spatial direction (e.g., y-axis); and the interaction between the positioning peg 46' and the elongated recess 46 and the interaction between the step 48' and the biasing element 48" may maintain the position of the first spine element 602 relative to the second spine element 604 in a third spatial direction (e.g., z-axis). The second lateral surface 28 of the first spine element 602 and/or the first lateral surface 26 of the second spine element 604 may have another spine element 18 affixed (e.g., removably coupled) to the respective lateral surface 26 and/or 28. Alternatively, the cover elements 14 and/or 16 having the latching mechanism halves 36' and 36" may be removably coupled to the lateral surfaces 26 and/or 28 of the outermost spine element(s) 18.

In some instances, a consumer may wish to remove, rearrange and/or insert the spine element 18 into the existing album 200. To remove any spine element 18 within the album 200, initially, the biasing element 48" is pivoted via a protrusion or grasping device 50 that extends from an end 702 (see, for example, FIG. 7*a*) of the spine element 18 as depicted in FIG. 7*d* along dashed lines 704 of FIG. 7*c* such that the biasing element 48" detaches the step 48' and the spine elements 18 shift such that they are no longer parallel to one another and the spine elements 18 shift longitudinally relative to one another as depicted in FIG. 7*b*. Once the biasing element 48" detaches the step 48', the spine elements 18 can be pivoted relative to one another along the axis of the positioning peg 46' until the lateral wall sections 40' and 40" are removed from the slots 38" and 38' as depicted in FIG. 7*a* and, thus, the spine elements 18 can be separated from one another by off-lifting. Additional spine elements 18 may then be added to the existing album 200 in a similar manner as described above. In some examples, each of the spine elements 18 may be provided with the album sheet insert 12' that may include, for example, ten album sheets 12. In some examples, the album sheets 12 may be coupled to the spine element 18 via sonic welding, heat welding or any other suitable means. However, in other examples as discussed below, the album sheets 12 may be coupled to the spine element 18 via a plurality of binding pins, inserts or fasteners 60 (see, for example, FIG. 10*e*).

Figures 8A, 8B, 8C, 8D, 8E, 8F:
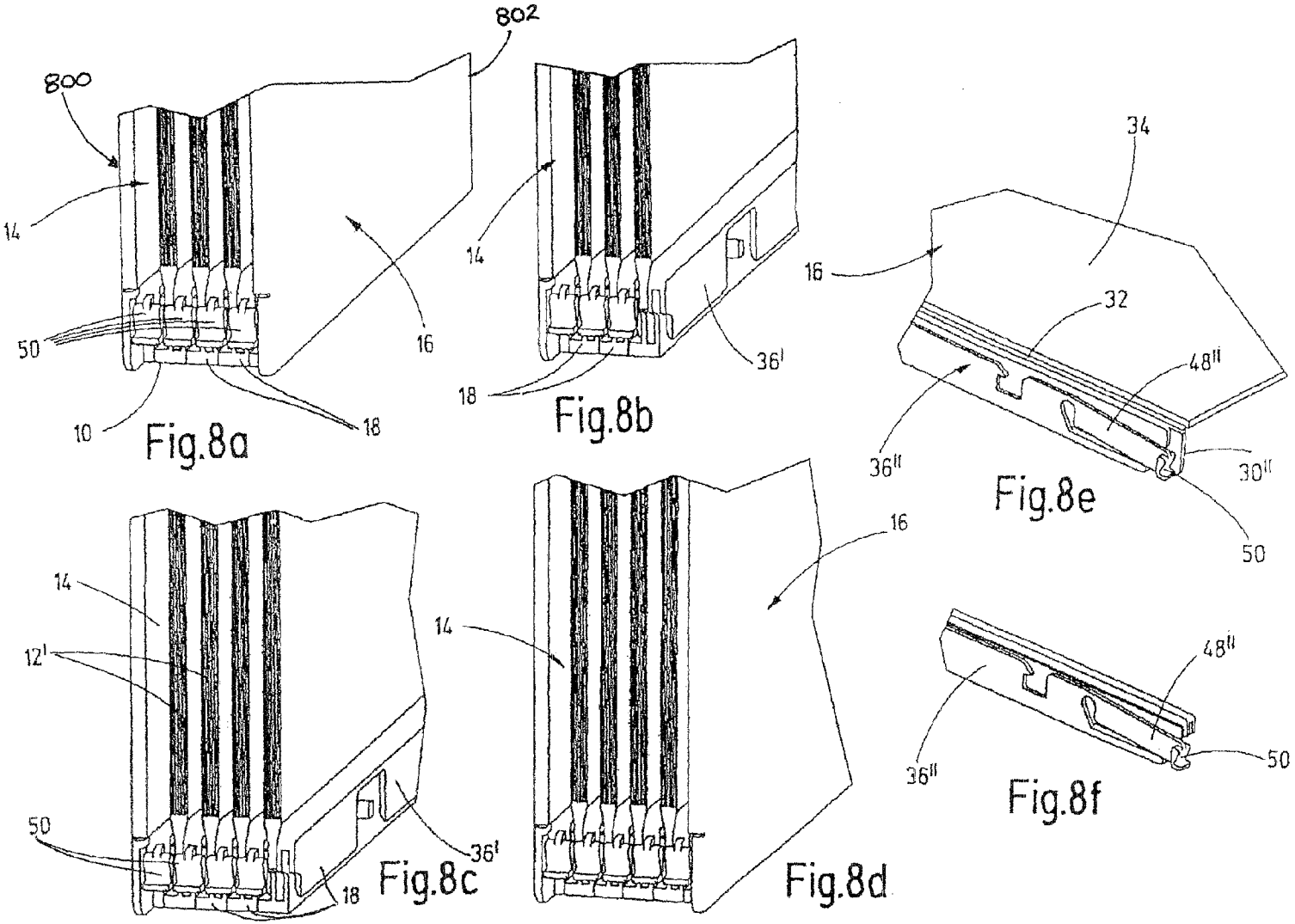
FIGS. 8*a*-8*d* depict an example process of adding additional spine elements having album sheets to the example album.
FIG. 8*e* depicts an example back cover element removed during the process depicted in FIGS. 8*a*-8*d*.
FIG. 8*f* depicts a biasing element of an example spine element to be removably engaged to a step of an adjacent example spine element as depicted in FIG. 8*b*.

FIGS. 8*a*-8*e* depict an example process of inserting an additional spine element 18 that is provided with the album sheet insert 12' into an example album 800. Turning to FIG. 8*a*, initially, the cover element 16 is removed from the album 800. The album 800 having the cover element 16 removed is depicted in FIG. 8*b*. The additional spine element 18 having the album sheet insert 12' is then attached to the album 800 as depicted in FIG. 8*c*. Next, the cover element 16 is recoupled to the album 800 as depicted in FIG. 8*d* and, thus, the album 800 now has relatively more album sheets 12 and is relatively thicker than the album 800 as depicted in FIG. 8*a*. The grasping devices 50 may be offset relative to an adjacent outer edge 52 (see, for example, FIG. 11*b*) of the cover elements 14 and 16 to substantially prevent any of the biasing elements 48" from being inadvertently activated via their respective grasping device 50 if, for example, the album 800 is positioned upright. Additionally, the width of the spine elements 18 may be relatively thicker than the width of the album sheet insert 12' prior to material being inserted into the album sheets 12. Specifically, the width of the spine elements 18 relative to the width of the album sheet insert 12' advantageously prevents the album 800 from becoming flared (e.g., the album spine 10 is thinner than an opposite edge 802 or 202 (see, for example, FIG. 1*a* of the album 200) and, thus, there is no need to use inserts (e.g., chip board inserts) to maintain a constant width of the album 800 once material is inserted into the album sheets 12.

Figure 9A:
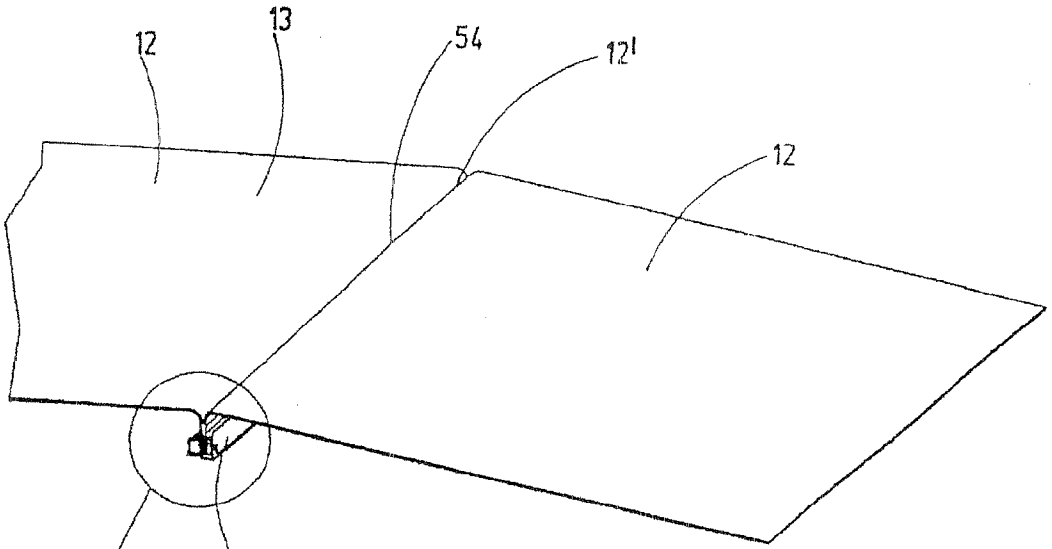
FIG. 9*a* depicts an example spine element having a multi-sheet album sheet insert.
Figure 9B:
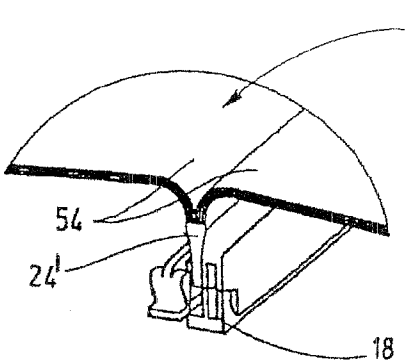
FIG. 9*b* depicts a portion of FIG. 9*a*.
Figure 9C:
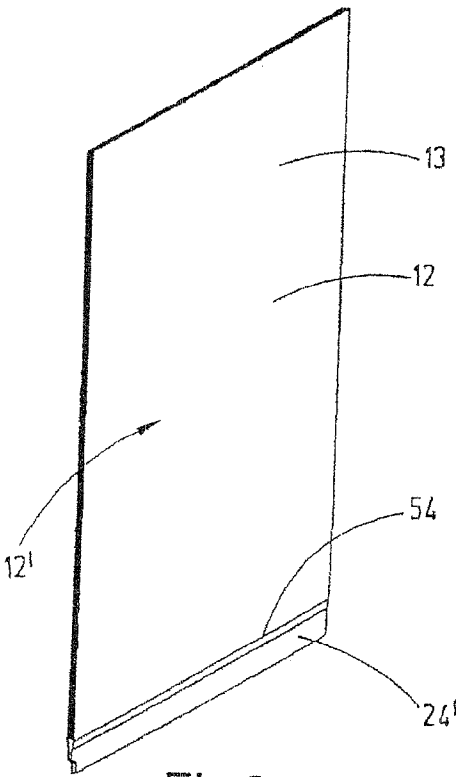
FIG. 9*c* depicts the multi-sheet album sheet insert of FIGS. 9*a* and 9*b* having an example molded-on insertion edge.

FIGS. 9*a*-9*c* and FIGS. 10*a*-10*e* depict two alternative implementations in which the album sheets 12 may be inserted into the binding gap 22 of the spine elements 18. In both implementations, the plurality of album sheets 12 are combined into the album sheet insert 12' such that the back edges' 24 of the plurality of album sheets 12 face the same direction. In the implementation depicted in FIGS. 9*a*-9*c*, a spine section 24' of the album sheet insert 12' is inserted into the binding gap 22 and coupled to the spine element 18 via a bonding agent or glue to provide a material-to-material connection. Each of the album sheets 12 has a relatively rigid cover section 13 that is coupled to the spine section 24' via an articulation or bending zone 54. The relatively rigid cover section 13 of the album sheets 12 may be pivoted about the articulation 54 as depicted in FIGS. 9*a* and 9*b* and opened by turning the individual album sheets 12.

Figures 10A, 10B, 10C, 10D, 10E, 10F:
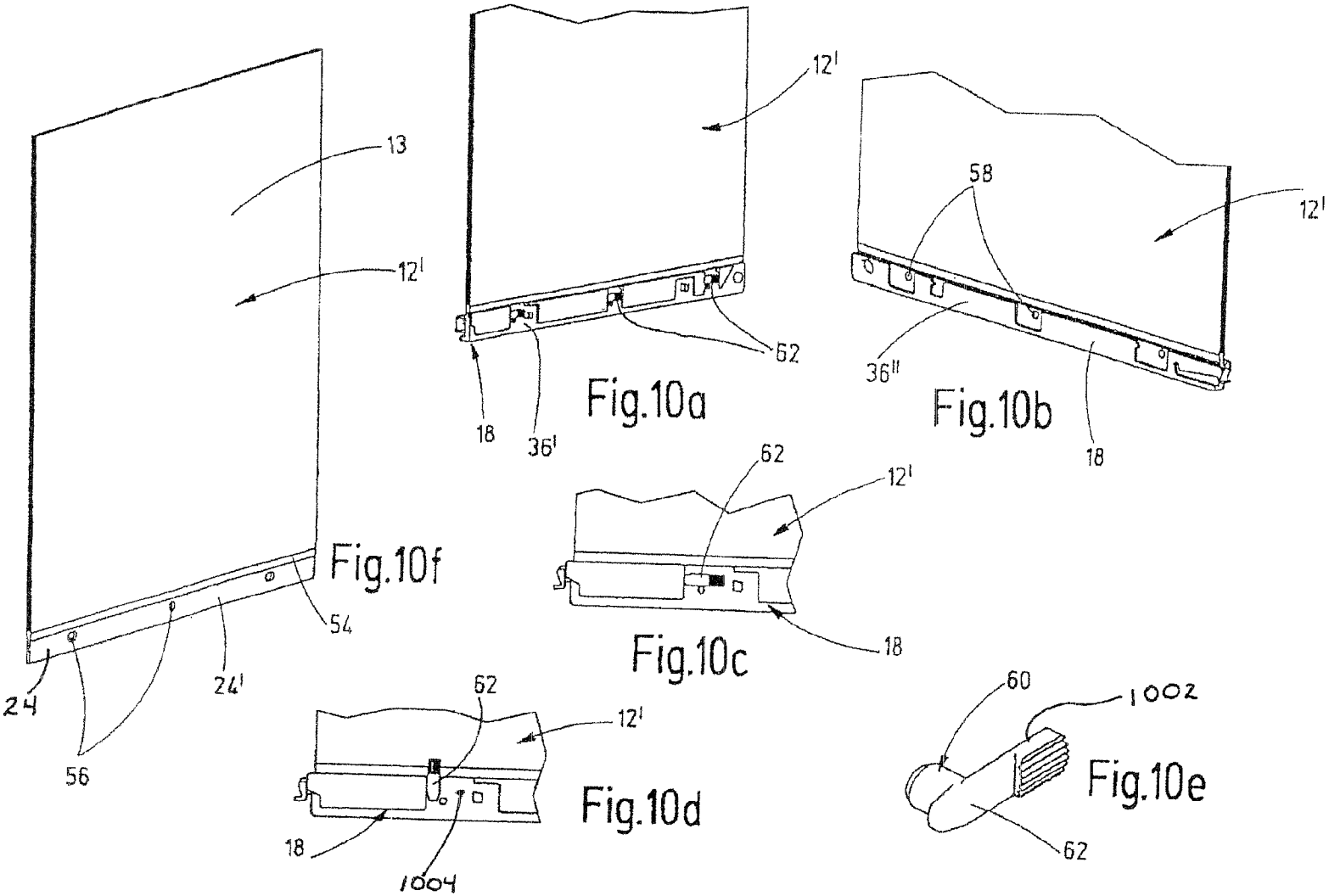
FIGS. 10*a*-10*b* depict an example spine element having a removably coupled example insert.
FIGS. 10*c*-10*d* depict a portion of FIG. 10*a* that illustrates the example insert in a latched position and an unlatched position, respectively.
FIG. 10*e* depicts the example insert of FIGS. 10*a*-10*d*.
FIG. 10*f* depicts an example album insert having a perforated edge.
Figure 11A:
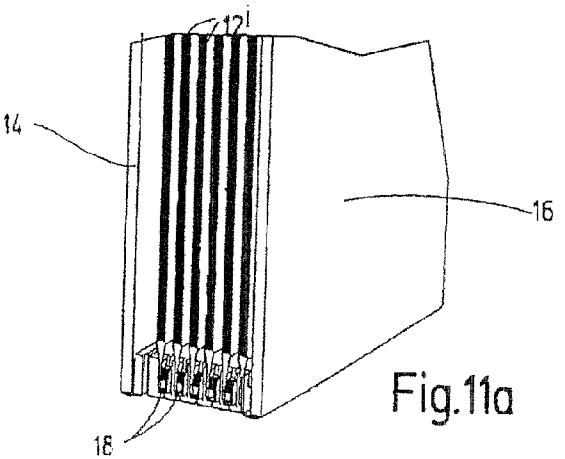
FIGS. 11*a*-11*b* depict an alternative example album having example cover elements coupled onto the spine.
Figure 11C:
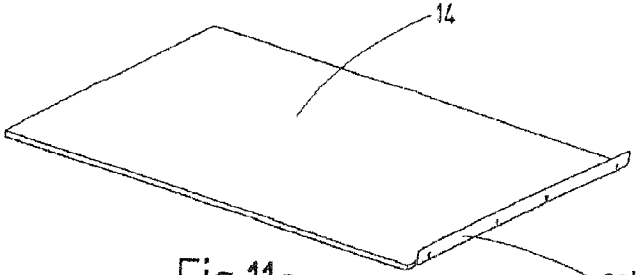
FIG. 11*c* depicts an example cover element.
Figure 11D:
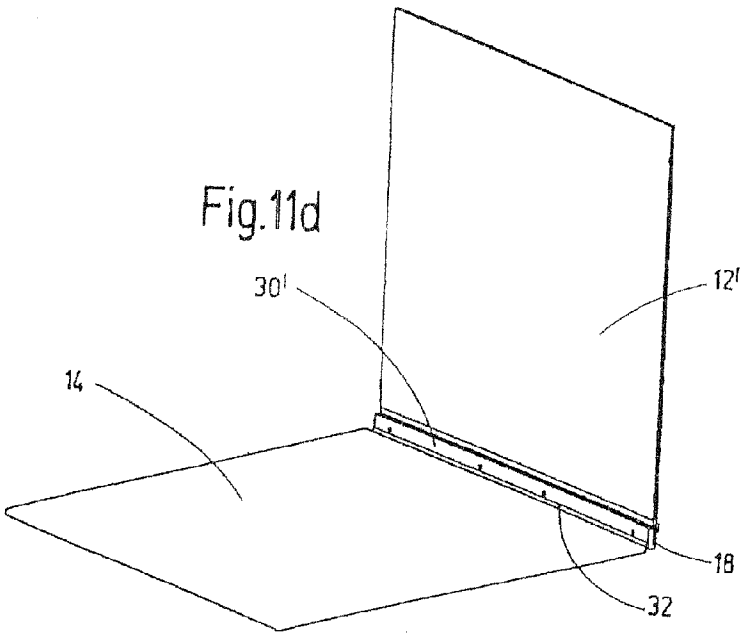
FIG. 11*d* depicts an example cover element and an example spine element having an album sheet insert.
Figure 11B:
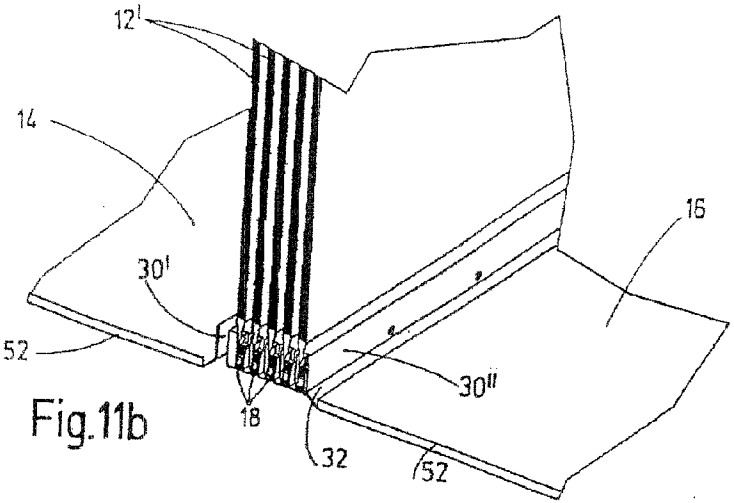

In contrast, in the example implementation of FIGS. 10*a*-10*f*, the spine section 24' of the album sheet insert 12' is provided with transverse through holes or binding holes 56 that are advantageously utilized to couple the album sheet insert 12' within the binding gap 22 of the spine element 18. The spine elements 18 have the latching mechanism halves 36' and 36" on the lateral surfaces 26 and 28. Adjacent the openings 42' and 42", and at a distance from the binding holes 56, cutouts 58 are provided to accept the binding pin(s) 60. The binding pins 60 are positioned through the cutouts 58, the binding holes 56 and the binding gap 22 and pivoted approximately 90 degrees via a latch arm 62 adjacent, for example, the first lateral surface 26. FIGS. 10*a* and 10*c* depict the binding pins 60 in the latched position and the latch arm 62 adjacent the first lateral surface 26. FIG. 10*d* depicts the binding pins 60 in the unlatched position and the latch arm 62 adjacent the first lateral surface 26. The spine section 24' of the album sheet insert 12' is positioned within the binding gap 22 of the spine element 18 via form-fitting.

Figures 13A, 13B, 13C, 13D, 13E:
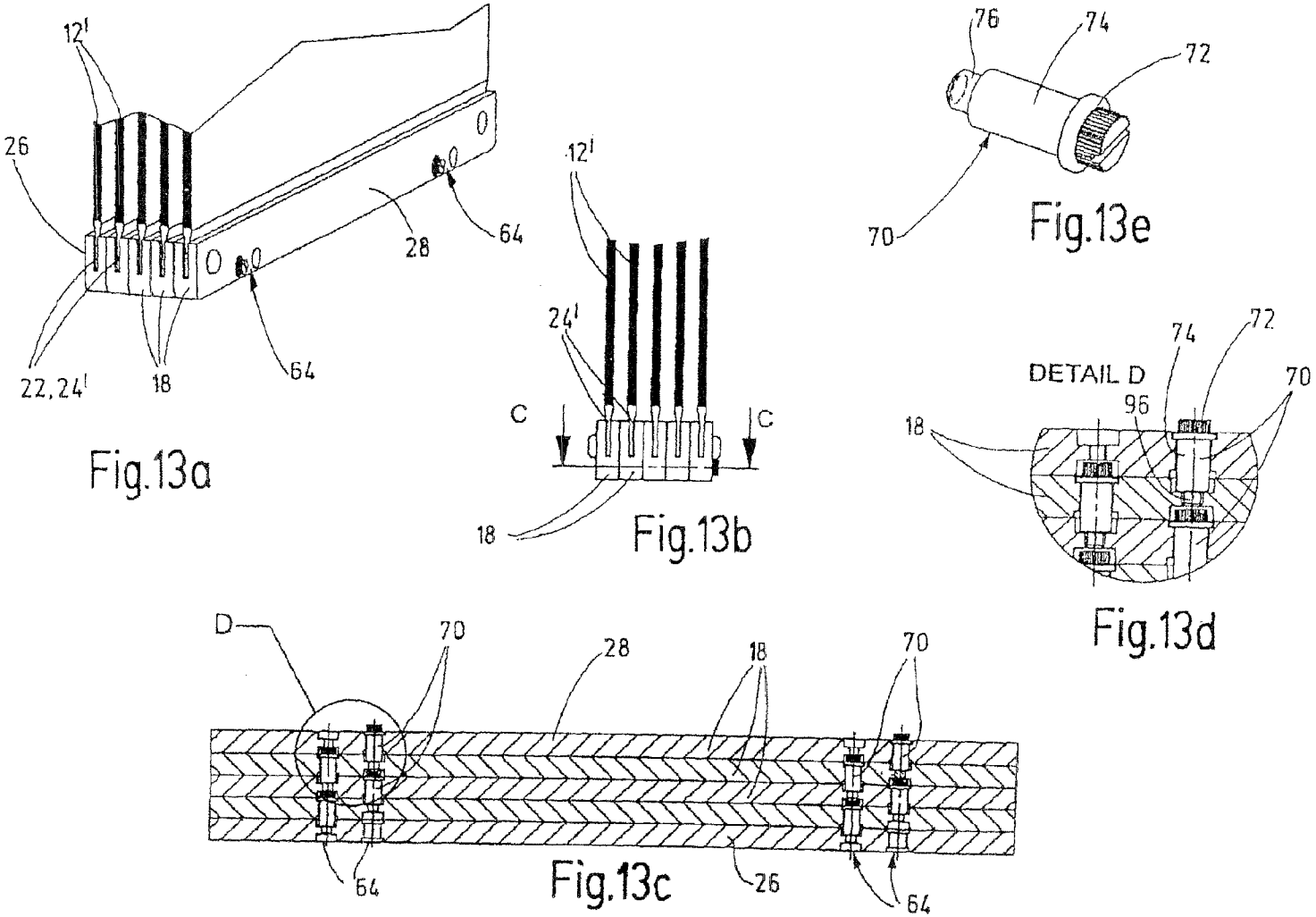
FIG. 13*a* depicts another example album in which example spine elements are coupled together via fasteners in pairs.
FIG. 13*b* depicts a front view of the example album of FIG. 13*a*.
FIG. 13*c* depicts a cross-sectional view along line C-C of FIG. 13*b*.
FIG. 13*d* depicts a portion of the cross-sectional view of FIG. 13*c*.
FIG. 13*e* depicts an example fastener that may be used to implement the example album of FIGS. 13*a*-13*d*.
Figure 14A:
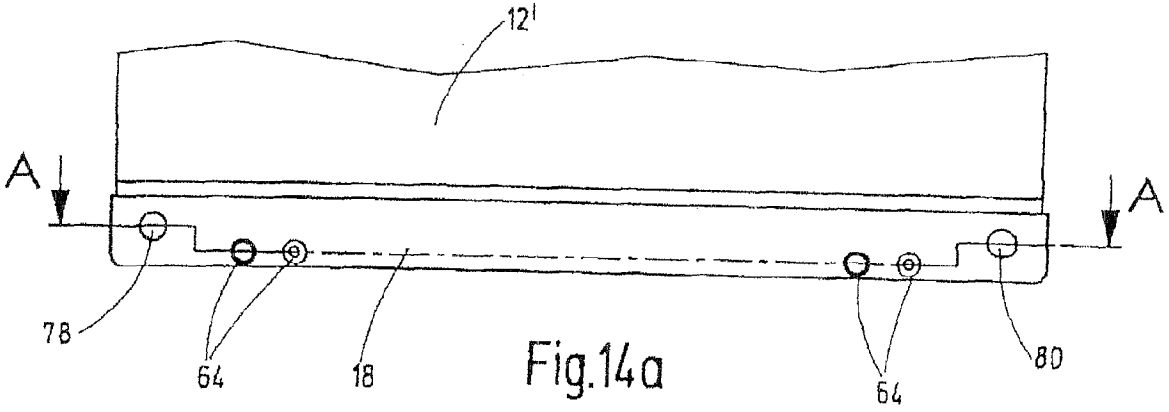
FIGS. 14*a*-14*c* depict various views of an example spine element used to implement the example album of FIG. 13*a*.
Figure 14B:
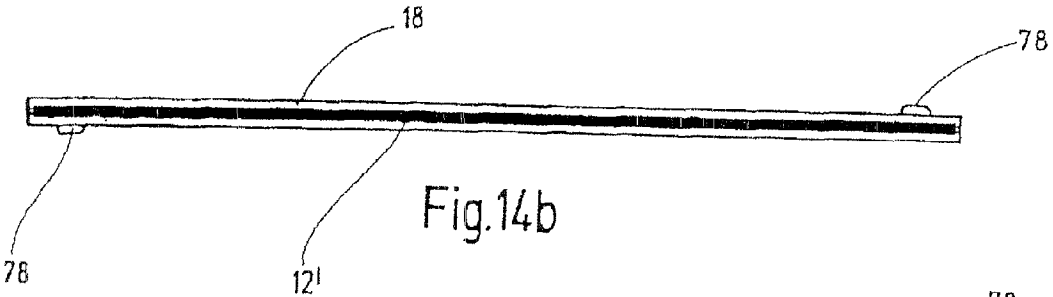
Figure 14C:
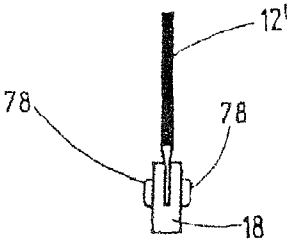
Figure 14D:
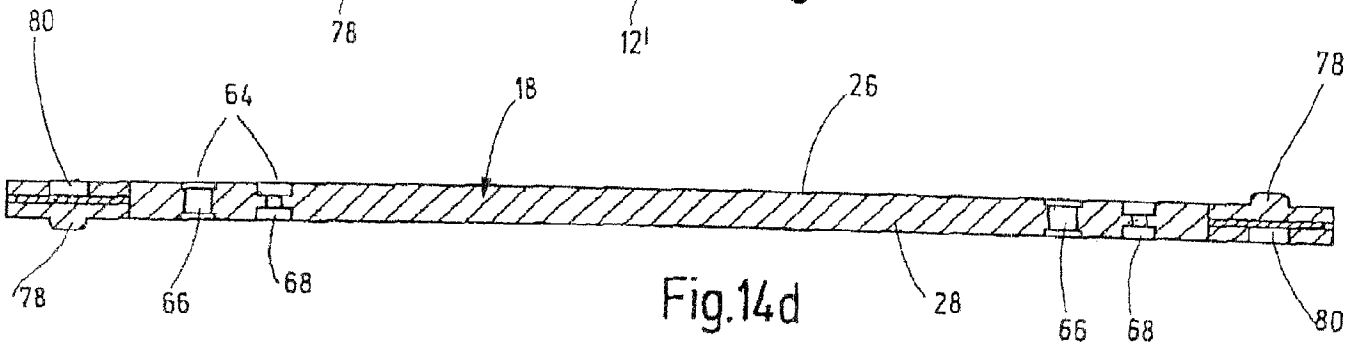
FIG. 14*d* depicts a cross-sectional view along line A-A of FIG. 14*a*.

FIGS. 13*a* and 14*d* depict alternative implementations in which the spine elements 18 are fastened to one another and/or to the covers element 14 and/or 16 via fasteners or headscrews 70. The spine elements 18 have a plurality of transverse holes 64 positioned at a distance from one another. Some of the holes 64 include a passage hole 66 (see, for example, FIG. 14*d*) and some of the holes 64 include a threaded hole 68 (see, for example, FIG. 14*d*). If a plurality of spine elements 18 are positioned adjacent one another, the passage holes 66 of one of the spine elements 18 align with the threaded holes 68 of the other spine element 18. The fastener 70 is inserted into the passage hole 66 and threaded into the threaded hole 68 to couple the adjacent spine elements 18 together as depicted in FIGS. 13*c* and 13*d*. Turning to FIGS. 13*d* and 13*e*, the fastener 70 is provided with a head 72, a non-threaded surface 74 and a threaded surface 76. Additionally, the lateral surfaces 26 and 28 of the spine elements 18 are provided with protrusions or positioning pegs 78 and positioning recesses 80. In this example implementation, the first lateral surface 26 is provided with both the positioning peg 78 and the positioning recess 80 that are on opposite ends of the spine element 18. Additionally, the second lateral surface 28 is provided with both the positioning peg 78 and the positioning recess 80 that are on opposite ends of the spine element 18. The positioning peg 78 of the first lateral surface 26 is positioned opposite the positioning recess 80 of the second lateral surface 28 and the positioning recess 80 of the first lateral surface 26 is positioned opposite the positioning peg 78 of the second lateral surface 28. In practice, the holes 64, the fasteners 70, the positioning pegs 78 and the positioning recesses 80 can be advantageously utilized to remove, rearrange and/or insert spine elements 18 to change the size or order of the album sheets 12.

FIGS. 15*a*-15*d* and 16*a*-16*b* depict an alternative implementation in which the spine elements 18 are provided with a plurality of through holes 82 that are arranged in pairs and receive a latchable binding pin, fastener or insert 84 to couple the album sheets 12 or the album sheet inserts 12' to the spine element 18 and/or to removably couple the adjacent spine elements 18 together. The through holes 82 are arranged at a distance from one another and are to receive the binding pins 84 that have a length that corresponds to the wall thickness of two spine elements 18. In some examples, the through holes 82 are designed substantially similar to the structure of a key-hole. In practice, to couple the adjacent spine elements 18 together, the binding pins 84 are inserted into every other though hole 82. Each of the binding pins 84 are provided with a protrusion or projecting locking bolt 86, which by turning or twisting the binding pin 84, positions the projecting locking bolt 86 behind the adjacent spine element 18.

Figure 15B:
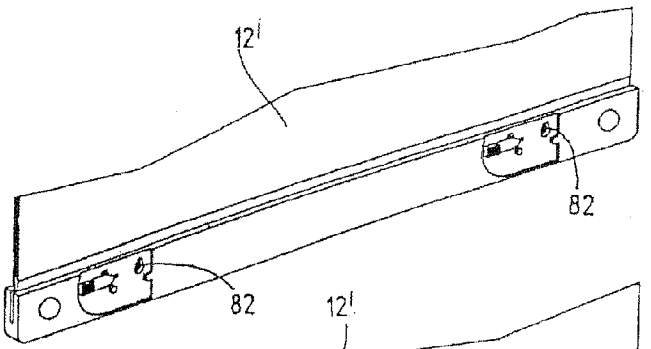
FIGS. 15*b*-15*c* depict the example spine element and album sheet of FIG. 15*a* having example inserts in a latched position and an unlatched position, respectively.
Figure 15C:
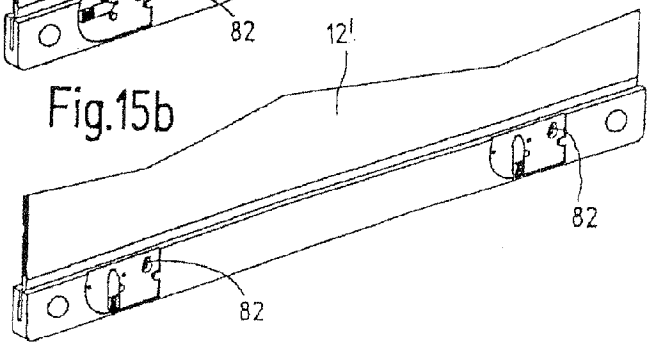
Figure 15D:
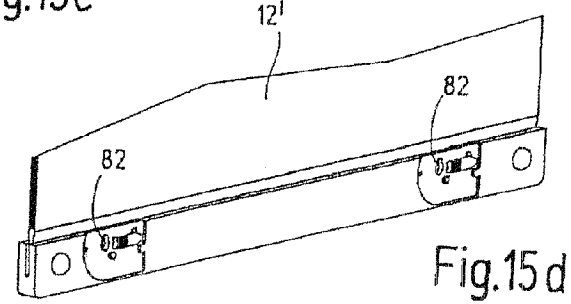
FIG. 15*d* depicts an example album sheet coupled to an example spine element having example inserts in the latched position.
Figure 15A:
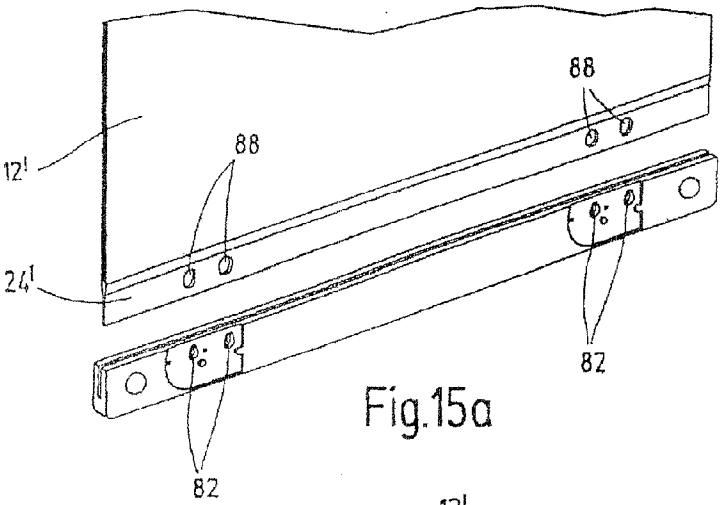
FIG. 15*a* depicts an exploded view of another example spine element and an album sheet insert.
Figure 15E:
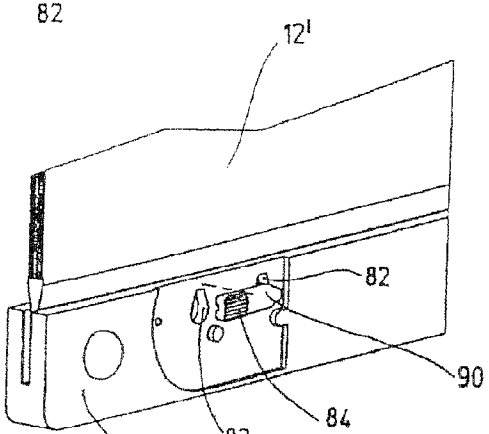
FIG. 15*e* depicts an enlarged portion of FIG. 15*b*.
Figure 16A:
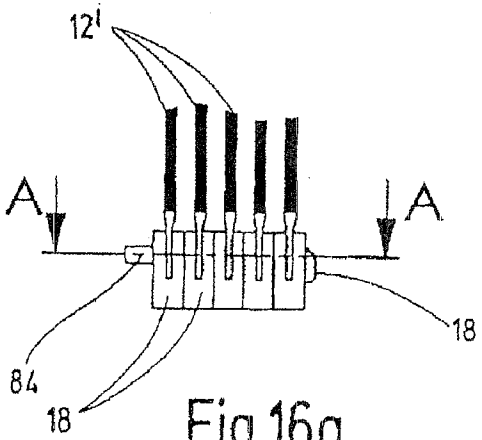
FIG. 16*a* depicts a front view of a plurality of album sheet inserts coupled to their respective example spine elements according to FIGS. 15*a*-15*f*.
Figure 15F:
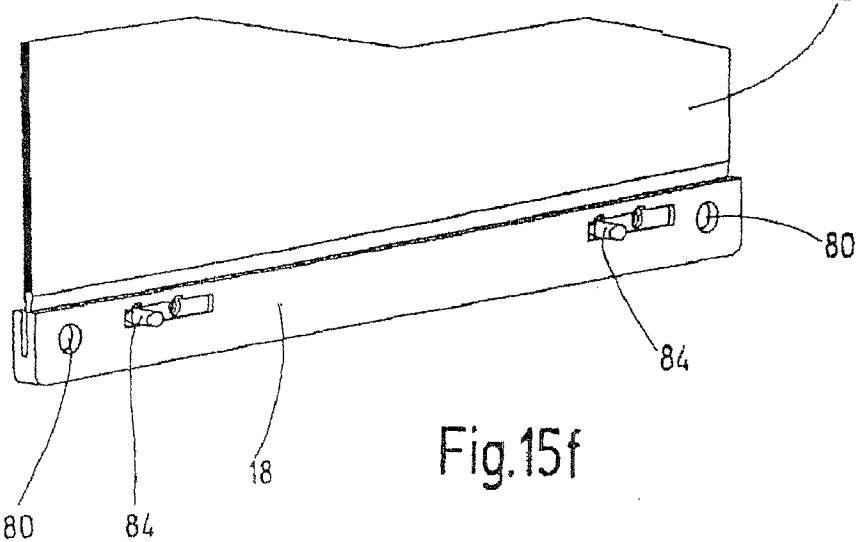
FIG. 15*f* depicts an alternative lateral view of the example spine element of FIG. 15*d* having inserts projecting from the example spine element.
Figure 16B:
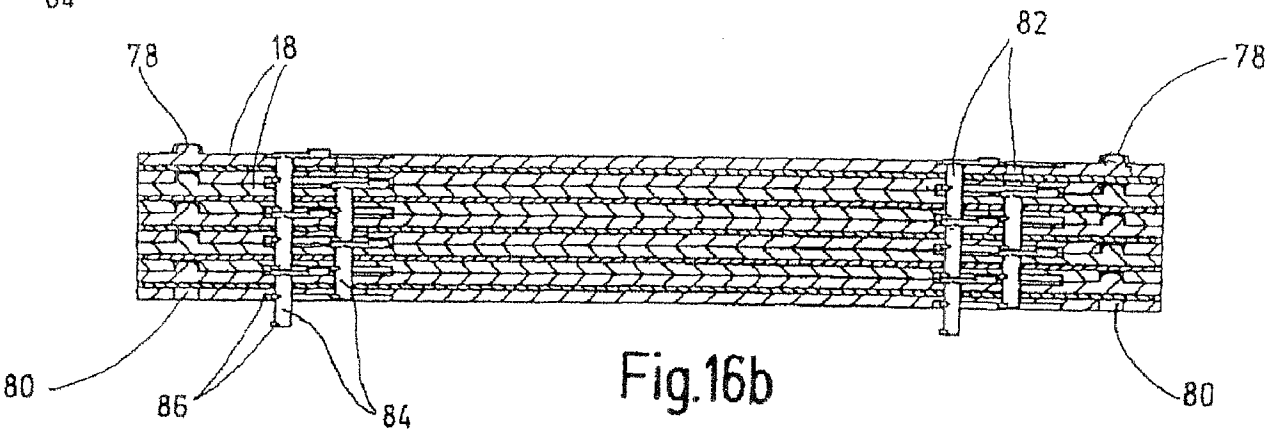
FIG. 16*b* depicts a cross-sectional view along line A-A of FIG. 16*a*.

Additionally, the spine section 24' of the album sheet inserts 12' is provided with equidistant through hole pairs 88 that correspond to the through holes 82 of the spine element 18 once the album sheet insert 12' is positioned partially within the spine element 18 to create a from-fit. The binding pins 84 are provided with a latch arm 90, which enables a consumer to rotate or pivot the binding pin 84 within the through hole 82 between a latched position as depicted in FIGS. 15*b*, 15*d* and 15*e* and an unlatched position as depicted in FIG. 15*c*. As illustrated in FIGS. 15*b* and 15*d*, the binding pins 84 may be inserted into either of the through holes 82 and, as such, an area in which the binding pins 84 may be positioned in the latched position is provided for the corresponding through holes 82.

Figures 17A, 17B:
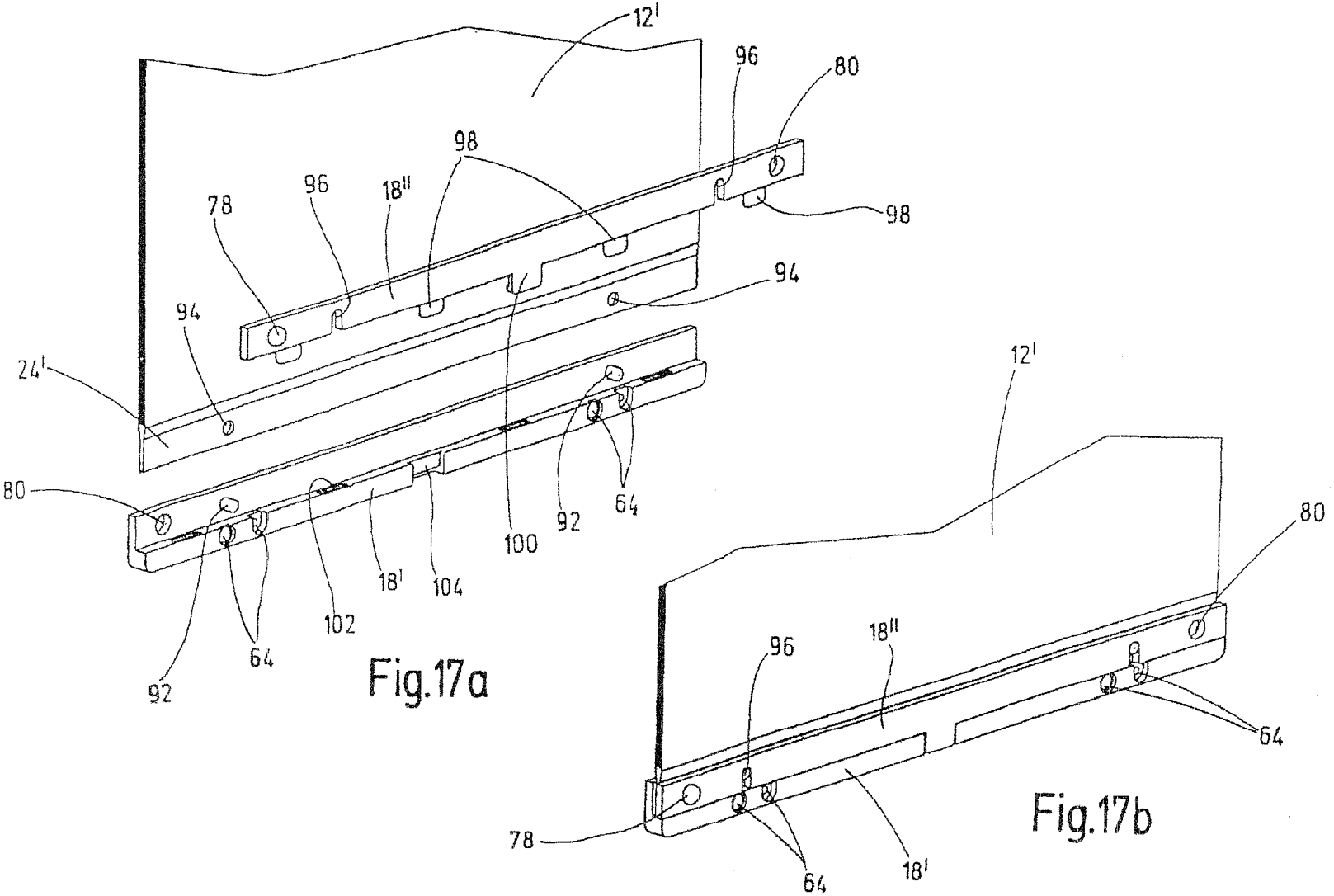
FIGS. 17*a*-17*b* depict an example process of coupling an album sheet insert to an alternative spine element.
Figures 18A, 18B, 18C, 18D, 18E:
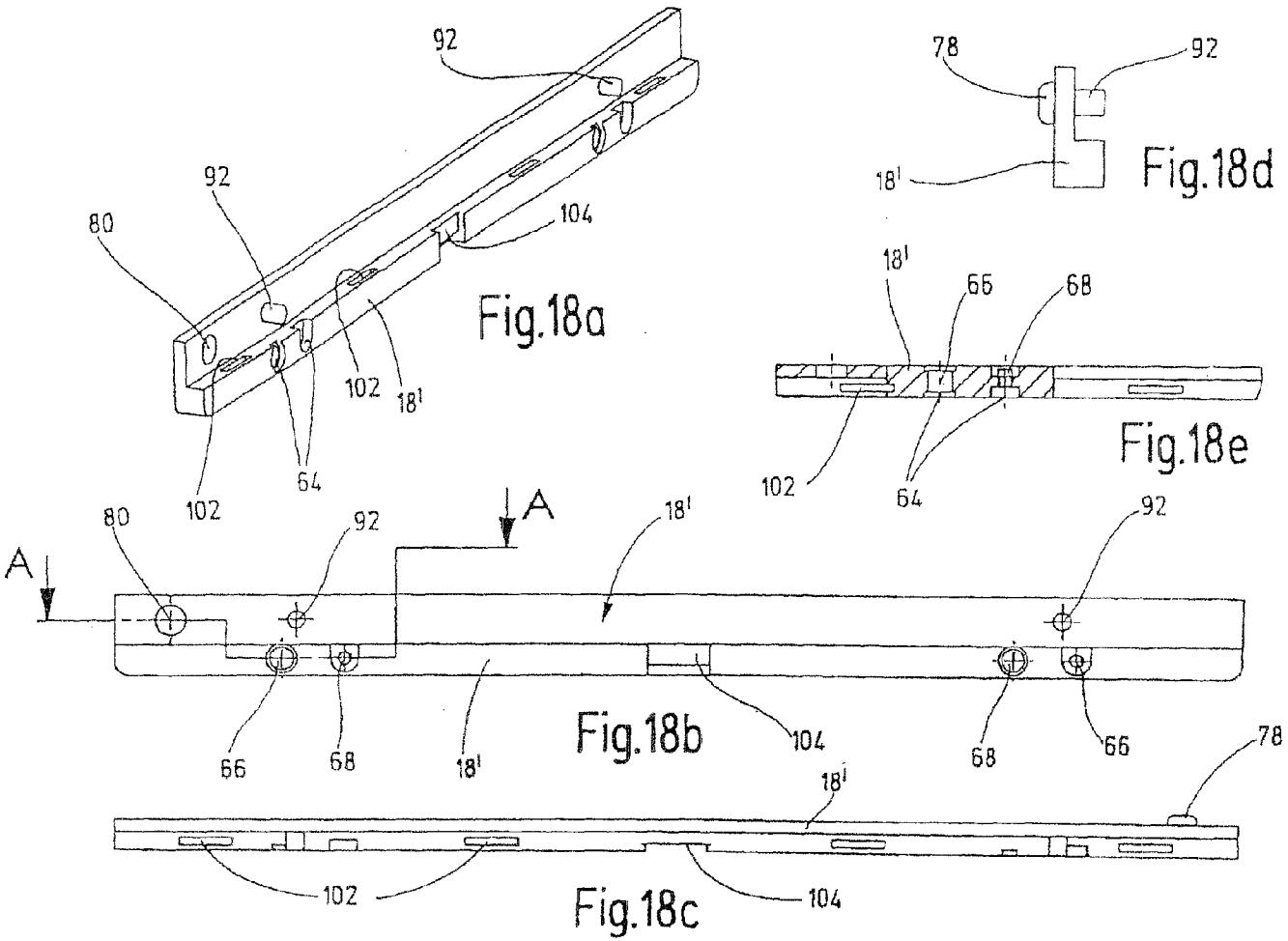
FIGS. 18*a*-18*d* depict various views of the alternative spine element of FIG. 17*a*.
FIG. 18*e* depicts a cross-sectional view along line A-A of FIG. 18*b*.
Figure 19D:
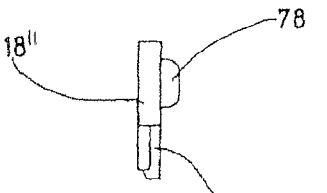
FIGS. 19*a*-19*d* depict various views of an example insertion slat used to implement the alternative spine element of FIGS. 17*a*-17*b*.
Figure 19E:
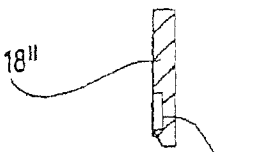
FIG. 19*e* depicts a cross-sectional view along line B-B of FIG. 19*a*.
Figure 19C:
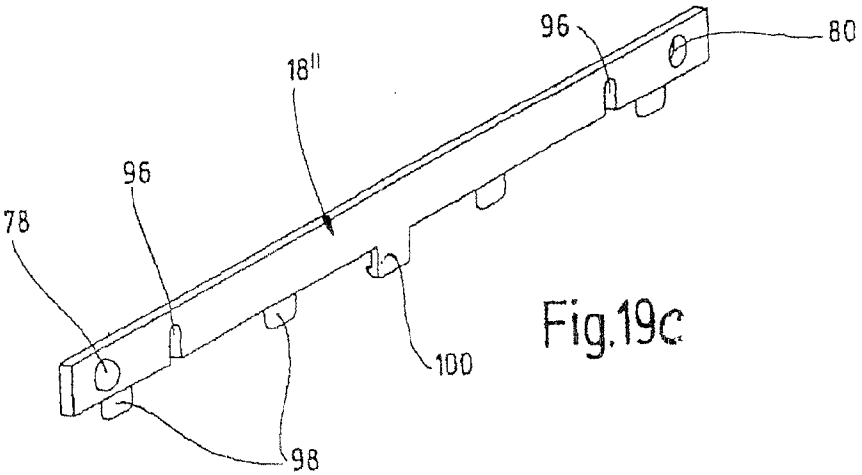
Figure 19A:
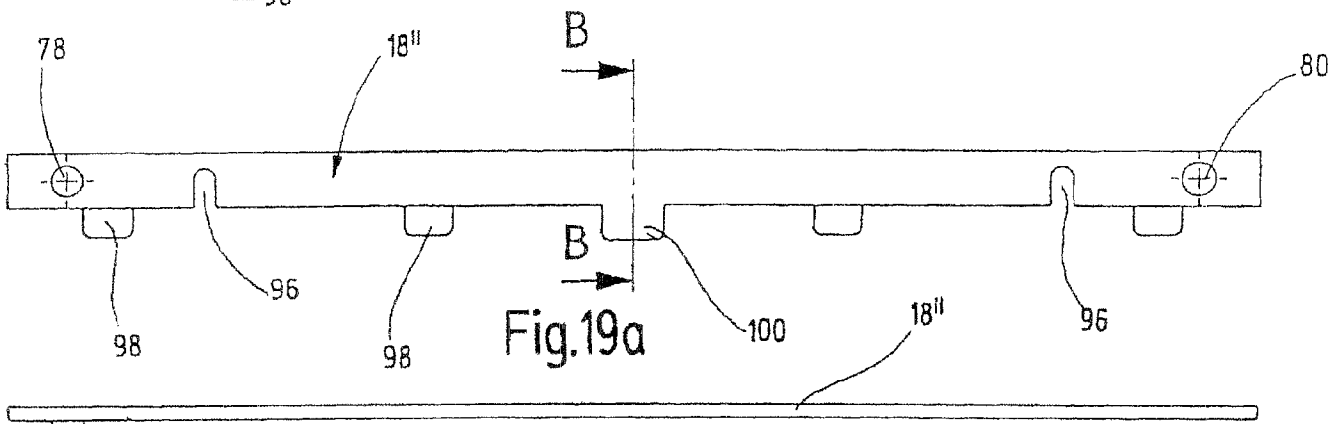
Figure 19B:
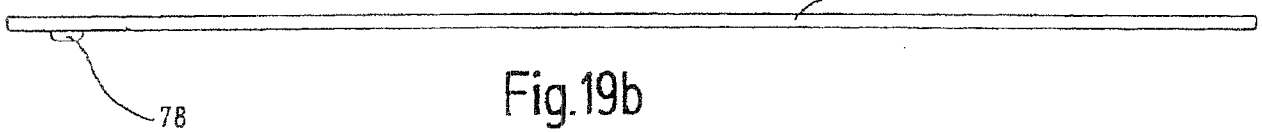

While the example implementations depicted in FIGS. 1-16 illustrate spine elements 18 that are molded from a single plastic piece, in contrast, the example implementations depicted in FIGS. 17*a*-17*b*; 18*a*-18*e*; and 19*a*-19*e* illustrate spine elements 18 that include a plurality of example first and second slat parts 18' and 18". The slat parts 18' and 18" are each provided with flanks to define the binding gap 22. Specifically, the slat parts 18' and 18" each define a portion of the binding gap 22. The slat parts 18' and 18" are interlatched and are utilized to clamp the album sheets 12 into the spine element 18 that includes the slat parts 18' and 18". As depicted in FIG. 17*a*, protrusions or binding pegs 92 are formed on the first slat part 18' at a distance from one another, which correspond to binding holes 94 through the spine section 24' and to open-edge cutouts 96 in the second slat part 18". The second slat part 18" is provided with a plurality of guide tongues 98 and a latching tongue 100 that correspond to guide openings 102 and a latching opening 104 of the first slat part 18' (L-shaped slat part). Specifically, in the mounted state (e.g., latched position), the guide tongues 98 are at least partially positioned in the corresponding guide openings 102 and the latching tongue 100 engages the latching opening 104. While the example implementation of FIG. 17*a* depicts the second slat part 18" having four guide tongues 98, in other examples, the second slat part 18" may be provided with any other number of guide tongues (e.g., 1, 2, 3, 4, 5, etc.). Additionally, while the example implementation of FIG. 17*a* depicts the first slat part 18' having one latching tongue 100, in other examples, the first slat part 18' may be provided with any other number of latching tongues (e.g., 1, 2, 3, 4, 5, etc.). To couple the spine elements 18 together, the first slat part 18' is provided with the plurality of holes 64 that are arranged in pairs and receive the fastener 70 (see, for example, FIG. 13*e*) to removably couple the adjacent spine elements 18 together. Some of the holes 64 include the passage hole 66 (see, for example, FIG. 18*e*) and some of the holes 64 include the threaded hole 68 (see, for example, FIG. 18*e*). Additionally, as discussed above, the slat parts 18' and 18" are provided with the positioning pegs 78 and the positioning recesses 80 to ensure proper alignment of the spine elements 18 relative to one another.

Figures 12A, 12B:
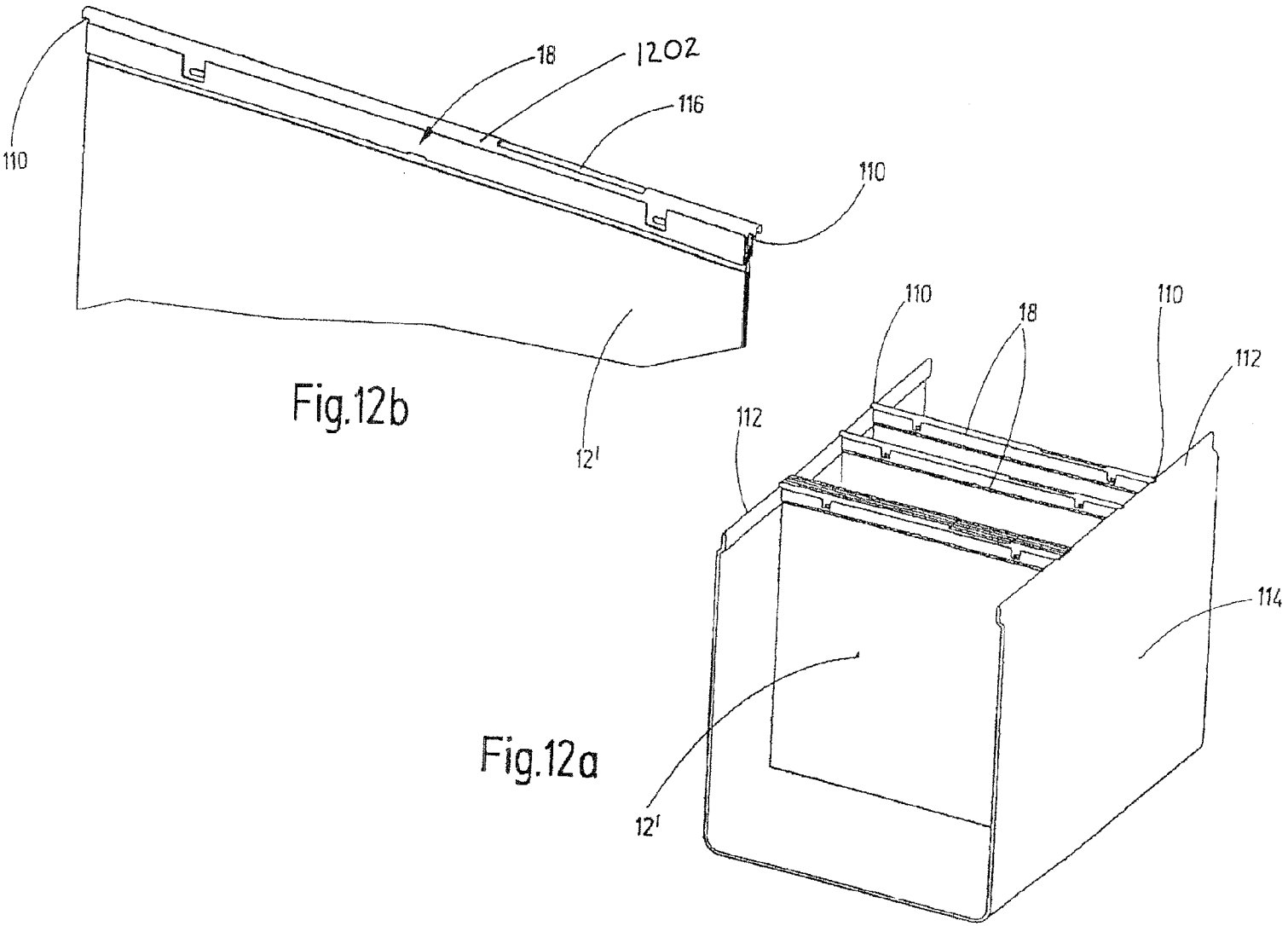
FIGS. 12*a*-12*b* depict an example hanging file system including spine elements provided with example album sheets.

FIGS. 12*a* and 12*b* depict an example implementation in which the spine elements 18 may be advantageously utilized in hanging file systems that may be used for office applications. Specifically, the ends of each of the spine elements 18 may be provided with projections, hook(s) or hanging device(s) 110 that engage suspension edges or rails 112 of a file container 114. Additionally, a back outside surface 1202 of the spine elements 18 may be provided with a marking field 116 to attach an indicator, sign, or marking, etc. for filing purposes and/or to enable a user to readily identify the contents contained within a particular spine element 18.

The example albums described herein have variable capacity while maintaining stability and a closed spine view.

As discussed above, the album spine 10 includes the plurality of spine elements 18 that are removably coupled to the adjacent spine elements 18 or to the cover elements 14 and/or 16. Each of the spine elements 18 is provided with the binding gap 22 positioned toward the album interior 20 of the album 200 for receiving and affixing the back edge 24 of at least one of the album sheets 12. Providing each of the spine elements 18 with at least one album sheet 12 advantageously enables a consumer to remove, rearrange and/or insert the spine element(s) 18 of the existing album 200 without disassembling the entire album spine 10.

Preferably, the spine elements 18 may have the shape of a slat or rod, which has a substantially rectangular cross-section. However, in other examples, the spine elements 18 may have any other suitable shape and/or cross-section. In the mounted state, the spine elements 18 are positioned adjacent one another in pairs such that the first lateral surface 26 of the first spine element 602 is adjacent the second lateral surface 28 of the second spine element 604. The plurality of adjacent spine elements 18 comprise a back wall (e.g., a closed coherent back wall) of the album spine 10.

The spine elements 18 may be injection molded and may be made of a plastic material. However, in other examples, the spine elements 18 may be produced by any other suitable method and/or may be made of any other suitable material. The album sheets 12 may comprise a substantially flat material such as, for example, a paper sheet, a cardboard sheet, a transparent pocket, a presentation pocket, a plastic sheet, a textile swatch, a wallpaper swatch, a carpet swatch, or any other suitable material.

In practice, the album sheets 12 are affixed or coupled by positioning the back edges 24 of the album sheets 12 into the binding gap 22 of the spine elements 18 by form-fitting, force-fitting, and/or material-to-material fitting. The binding gap 22 is sized to accept and/or receive the plurality of album sheets 12 that may be assembled into the album sheet insert 12'. Each of the album sheets 12 within the album sheet insert 12' is positioned in the same direction within the binding gap 22 such that the album sheet insert 12' along with the affixed spine element 18 may be a replacement portion and/or an exchangeable layer within the album 200. The album sheets 12 are provided with the relatively rigid cover section 13 that is positioned at a distance and running substantially parallel to the binding gap 22 to enable a consumer to relatively easily turn individual or a group of album sheets 12 within the album 200.

In some examples, the back edges 24 of the album sheets 12 may be provided with the binding holes 56 or 94 or through holes 88 that are arranged at a distance from one another. To affix the album sheets 12 to the spine elements 18, the binding pins 60 or 84 or the binding pegs 92 are positioned through the binding holes 56 or 94 or the through holes 88 and the binding gap 22 of the spine elements 18 transversely. In some example implementations, to enable a consumer to interchange album sheets 12 within a particular spine element 18, the spine elements 18 are provided with the cutouts 58, the through holes 82 and/or the open-edge cutouts 96 to enable the binding pins 60 or 84 to be inserted through the binding holes 56 or 94 or the through holes 88 and the binding gap 22 of the spine element 18. The cutouts 58, the through holes 82 and/or the open-edge cutouts 96 are positioned in a substantially transverse direction relative to the binding gap 22. In some examples, the binding pins 60 or 84 may be provided with the latch arm 62 or 90 that is to be positioned outside of the binding gap 22, such as adjacent the first lateral surface 26. The latch arm 62 or 90 may be pivoted or rotated about the axis of the binding pins 60 or 84 between the latched position or the unlatched position relative to the associated spine element 18. In some examples, the binding pins 60 or 84 define a groove 1002 (see, for example, FIG. 10*e*) that corresponds to a rib 1004 of the spine element 18, which maintains the position of the binding pin 60 or 84 in the latched position. Specifically, as the binding pin 60 or 84 is pivoted or rotated, the groove 1002 is adjacent the first lateral surface 26. As the binding pin 60 or 84 engages the rib 1004, the binding pin 60 or 84 partially deforms enabling the rib 1004 to be positioned within the groove 1002.

As described above, the cover elements 14 or 16 may be provided with the respective spine sections 30' or 30" that are positioned adjacent the album spine 10. The cover elements 14 or 16 may be coupled to (e.g., material-to-material fitting) or removably coupled to the adjacent spine element 18 via its' spine section 30' or 30". If the spine section 30' and/or 30" is undetachably molded, welded or glued to the adjacent spine element 18, the spine section 30' and/or 30" may form the spine element 18.

As discussed above, the spine elements 18 may be fastened via, for example, the fasteners 70, to an adjacent spine element 18 and/or to one of the cover elements 14 or 16 in pairs. The spine elements 18 may be provided with the plurality of transverse holes 64 positioned at a distance from one another, which penetrate the spine elements 18. Some of the holes 64 include the passage hole 66 (see, for example, FIG. 14*d*) and some of the holes 64 include the threaded hole 68 (see, for example, FIG. 14*d*). If a plurality of spine elements 18 are positioned adjacent one another, the passage holes 66 of one of the spine elements 18 align with the threaded holes 68 of the other spine element 18. The fastener 70 is inserted into the passage hole 66 and threaded into the threaded hole 68 to couple the adjacent spine elements 18 together as depicted in FIGS. 13*c* and 13*d*.

To removably couple the cover elements 14 or 16 to the adjacent spine element 18, the spine section 30' and/or 30" may define a plurality of transverse holes that are positioned at a distance from one another. The transverse holes of the spine sections 30' and 30" are substantially similar to the holes 64 of the spine elements 18. The transverse holes of the spine sections 30' and 30" correspond to the holes 64 of the spine elements 18 such that the fastener 70 may couple the spine section 30' and/or 30" to the adjacent spine element 18. The transverse holes of the spine sections 30' and 30" may be a passage hole similar to the passage hole 66 of the spine element 18 or the transverse holes of the spine sections 30' and 30" may be a threaded hole similar to the threaded hole 68 of the spine element 18.

Alternatively, to removably couple the cover elements 14 or 16 to the adjacent spine element 18, the spine section 30' and/or 30" may define a plurality of transverse holes that are positioned at a distance from one another. The transverse holes of the spine sections 30' and 30" are substantially similar to the holes 64 of the spine elements 18. The transverse holes of the spine sections 30' and 30" correspond to the holes 64 of the spine elements 18 such that the fastener 70 may couple the spine section 30' and/or 30" to the adjacent spine element 18. Specifically, the transverse holes of the spine section 30' or 30" may be a passage hole similar to the passage hole 66 and the transverse holes of the other spine section 30' or 30" may be a threaded hole similar to the threaded hole 68.

In still other example implementations, the spine elements 18 may be interlatched and/or removable coupled in pairs to the adjacent spine element 18 and/or to at least one of the cover elements 14 or 16. Specifically, the lateral surfaces 26 and/or 28 are provided with the latching mechanism 36 that includes, in the transverse direction, the lateral wall sections 40' and 40" that reach around the adjacent spine element 18 and are inserted into the corresponding slot 38" and 38' in a spring-like manner. Additionally, the latching mechanism 36 includes, in the longitudinal direction, the latching devices 44' and 44" that intermesh in a form-fit.

As described above, the latching mechanism 36 may be provided with the positioning peg 46' that protrudes from the first lateral surface 26 and corresponds to the elongated recess 46" defined by the second lateral surface 28 of the adjacent spine element 18. Opposite the positioning peg 46' and the elongated recess 46", the latching mechanism 36 is provided with the step 48' on the first lateral surface 26 that corresponds to the manually detachable biasing element 48" on the second lateral surface 28 of the adjacent spine element 18. The latching devices 44' and 44" are arranged between the positioning peg 46' and the elongated recess 46" and the step 48' and the biasing element 48". The latching devices 44' and 44" are interlatchable in the direction of rotation about the axis of the positioning peg 46' and subject to mutual longitudinal shifting of the spine elements 18 and the back grip (e.g., grasp) between the adjacent (e.g., facing) lateral wall sections 40' and 40".

The latching devices 44' and 44" are interlatchable subject to the mutual longitudinal shifting of the spine elements 18 against the force exerted by the biasing element 48". The biasing element 48" is provided with the grasping device 50 that extends from the end 702 of the associated spine element 18, which enables the biasing element 48" to be rotated and/or pivoted against the force of the biasing element 48" to disengage the biasing element 48" from the step 48'. To enable a consumer to easily access the grasping device 50, the grasping device 50 is externally accessible. Additionally, to prevent inadvertent depressing of the grasping device 50, the grasping devices 50 are slightly set back and/or are a distance from the adjacent outer edge 52 of the cover elements 14 or 16 toward the album interior 20 of the album 200 or 800.

In some examples, the spine elements 18 may comprise a single molded plastic part. However, in other example implementations, the spine element 18 may comprise the slat parts 18' and 18", which each have the corresponding flank of the binding gap 22. Once the album sheets 12 are properly positioned relative to the binding pegs 92, the slat parts 18' and 18" may be coupled and/or interlaced together. Specifically, the binding pegs 92 are formed on the first slat part 18' at a distance from one another and correspond to the binding holes 94 of the album sheets 12. Additionally, the binding pegs 92 are received by the open-edge cutout 96 of the second slat part 18". Further, the second slat part 18" may be provided with at least one latching tongue 100 and at least one guide tongue 98, which each correspond to the latching opening 104 and the guide opening 102, respectively.

As discussed above, the binding pins 84 may be inserted through, for example, two adjacent spine elements 18 or through one spine element 18 and one spine section 30' or 30". In some examples, the binding pins 84 may be connection bolts.

As described above, the spine section 30' or 30" of the cover elements 14 or 16 may include the latching mechanism half 36' or 36" that corresponds to the adjacent spine element 18 to form the latching mechanism 36. The cover elements 14 and/or 16 may include the cover section 34 that is coupled and/or molded onto the spine section 30' and/or 30". The cover elements 14 and/or 16 may be pivotable via the articulation 32, which is positioned at a distance from the corresponding spine element 18.

As discussed above, the spine elements 18 may be advantageously utilized in office setting. Specifically, the spine elements 18 may be provided with the hanging device(s) 110 that engage the suspension edges or rails 112 of the file container 114. In some examples, the hanging device(s) 110 may project outward relative to the spine element 18. However, in other examples, the hanging devices 110 may be rotatable or movable outward toward a position that projects from the spine element 18. Additionally, the back outside surface 1202 of the spine elements 18 may be provided with the marking field 116 to attach an indicator, sign, or marking, etc. for filing purposes and/or to enable a user to readily identify the contents contained within a particular spine element 18.

As described above, the spine elements 18 may be an elongated slat having a substantially rectangular cross-section. The spine elements 18 are provided with a plurality of lateral surfaces some of which define the binding gap 22. Specifically, one of the lateral surfaces may be an inner surface that forms an aperture that leads to the binding gap 22, and another lateral surface may be a closed outer surface that faces away from at least one of the other lateral surfaces. Additionally, the spine elements 18 are provided with the lateral surfaces 26 and 28 that include the respective latching mechanism halves 36' and 36", which complement one another.

In other example implementations, the spine elements 18 may be an elongated slat having a substantially rectangular cross-section. The spine elements 18 are provided with a plurality of lateral surfaces some of which define the binding gap 22. Specifically, one of the lateral surfaces may be an inner surface that forms an aperture that leads to the binding gap 22, and another lateral surface may be a closed outer surface that faces away from at least one of the other lateral surfaces. Additionally, the spine elements 18 are provided with the holes 64 to enable the fastener 70 to be inserted through the holes 64 and the binding gap 22 of the spine elements 18. Some of the holes 64 include the passage hole 66 (see, for example, FIG. 14*d*) and some of the holes 64 include the threaded hole 68 (see, for example, FIG. 14*d*).

As discussed above, at least one album sheet 12 is positioned within the binding gap 22. In practice, the album sheet(s) 12 and/or the album sheet insert 12' is positioned and clamped within the binding gap 22. Specifically, the binding pins 60 and 84 are inserted into the spine elements 18 and though the album sheet(s) 12 as described above. In some examples, the back edge 24 may be partially positioned within the binding gap 22.

Although certain example methods, apparatus and articles of manufacture have been described herein, the scope of coverage of this patent is not limited thereto. On the contrary, this patent covers all methods, apparatus and articles of manufacture fairly falling within the scope of the appended claims either literally or under the doctrine of equivalents.

What is claimed is:

1. An album, comprising, a first spine element;

a second spine element that is substantially similar to the first spine element, the first spine element to be removably coupled to the second spine element by positioning a peg of the first spine element into a recess of the second spine element and rotating the first spine element about an end relative to the second spine element to form an album spine, wherein the first spine element and the second spine element each include a binding gap positioned toward an interior of the album to receive and couple an edge of at least one album sheet to the respective spine element.

2. The album as defined in claim 1, wherein the album further comprises a third spine element and a fourth spine element.

3. The album as defined in claim 1, wherein the first spine element and the second spine element are substantially shaped as at least one of a slat or a rod having a substantially rectangular cross-section.

4. The album as defined in claim 1, wherein each of the first spine element and the second spine element is provided with a first lateral surface and a second lateral surface and wherein the first lateral surface of the first spine element is to be adjacent the second lateral surface of the second spine element.

5. The album as defined in claim 1, wherein the album spine comprises a substantially closed back wall.

6. The album as defined in claim 1, wherein each of the first spine element and the second spine element comprises a plastic material.

7. The album as defined in claim 1, wherein the album sheets are at least one of a substantially flat material, a paper material, a carton material, a cardboard material, a plastic material, a transparent material having a pocket to receive a substantially flat material object, a wallpaper material, or a carpet material.

8. The album as defined in claim 1, wherein the edge of the album sheet is coupled within the binding gap of the first spine element or the second spine element by at least one of form fitting, force fitting, or material-to-material fitting.

9. The album as defined in claim 1, wherein each of the first spine element and the second spine element includes protrusions positioned transverse to the binding gap and wherein the protrusions correspond to holes arranged along the edge of the album sheet.

10. The album as defined in claim 1, wherein each of the first spine element and the second spine element defines at least one cutout to receive a fastener to couple the album sheet to the respective spine element, wherein the at least one cutout is positioned transverse to the binding gap.

11. The album as defined in claim 10, wherein the fastener is provided with a latch arm that radially projects outside of the binding gap, wherein the latch arm is pivotable about an axis between a latched position and an unlatched position.

12. A spine element to be removably coupled to an adjacent spine element for use with albums, comprising, a binding gap positioned toward the interior of the album to receive and couple an edge of at least one album sheet to the spine element;

a latching mechanism comprising:

a plurality of lateral wall sections;

a first slot, wherein at least one of the plurality of lateral wall sections is to be partially positioned within a second slot defined by an adjacent spine element in a substantially spring like manner in the transverse direction;

a first latching device;

a second latching device, wherein the first latching device is to intermesh a third latching device of the adjacent spine element in a form-fit in the longitudinal direction;

a positioning peg formed on a first lateral surface;

a first elongated recess defined by a second lateral surface, wherein the positioning peg is to be at least partially positioned within a second elongated recess of the adjacent spine element;

a biasing element on the first lateral surface opposite the positioning peg; and a first step on the second lateral surface opposite the elongated recess, wherein the biasing element is to removably engage a second step of the adjacent spine element.

13. An album comprising:

a first spine element;

a second spine element that is substantially similar to the first spine element, wherein the first spine element is adjacent and removably coupled to the second spine element to form an album spine, wherein the first spine element and the second spine element each include a binding gap positioned toward an interior of the album to receive and couple an edge of at least one album sheet to the respective spine element, wherein each of the first spine element and the second spine element defines at least one cutout to receive a fastener to couple the album sheet to the respective spine element, wherein the at least one cutout is positioned transverse to the binding gap, wherein the fastener is provided with a latch arm that radially projects outside of the binding gap, wherein the latch arm is pivotable about an axis between a latched position and an unlatched position, wherein the latch arm defines a groove that corresponds to a rib of the first spine element and the second spine element to substantially maintain the position of the fastener relative to the respective spine element.

14. The album as defined in claim 1, wherein the album is provided with at least one cover element having a spine section, wherein the spine section is removably coupled to at least one of the first spine element or the second spine element.

15. The claim as defined in claim 1, wherein each of the first spine element and the second spine element comprises a first slat and a second slat, wherein the first slat and the second slat are removably couplable to each other and wherein the first slat and the second slat each define a portion of the binding gap.

16. The album as defined in claim 1, further comprising a plurality of fasteners to removably couple the first spine element to at least one of the second spine element or a cover element.

17. The claim as defined in claim 15, wherein protrusions are formed on the first slat positioned transverse to the binding gap and wherein the protrusions correspond to holes arranged along the edge of the album sheet and wherein the protrusions correspond to cutouts of the second slat.

18. The claim as defined in claim 15, wherein the second slat is provided with at least one guide tongue and at least one latching tongue, wherein the at least one guide tongue corresponds to at least one guide opening of the first slat.

19. The album as defined in claim 1, wherein a cover element is provided with a spine section having a latching mechanism half that is associated with at least one of a first latching mechanism half or a second latching mechanism half of at least one of the first spine element or the second spine element.

20. The album as defined in claim 19, wherein the cover element comprises a relatively rigid section and an articulation.

21. The album as defined in claim 1, further comprising an indicator on at least one of the first spine element or the second spine element, wherein the indicator is positioned adjacent an outside surface of at least one of the first spine element or the second spine element.

22. The album as defined in claim 1, wherein each of the first spine element and the second spine element is provided with projections to position the first spine element and the second spine element within a file container.

23. An album comprising:

a first spine element;

a second spine element that is substantially similar to the first spine element, wherein the first spine element is adjacent and removably coupled to the second spine element to form an album spine, wherein the first spine element and the second spine element each include a binding gap positioned toward an interior of the album to receive and couple an edge of at least one album sheet to the respective spine element; and a plurality of fasteners to removably couple the first spine element to at least one of the second spine element or a cover element, wherein each of first spine element and the second spine element defines a plurality of passage holes and a plurality of threaded holes both of which are positioned transverse to the binding gap, wherein the plurality of passage holes of the first spine element are to align with the plurality of threaded holes of the second spine element.

24. The album as defined in claim 1, wherein each of the first spine element and the second spine element is provided with a latching mechanism that comprises a plurality of lateral wall sections, wherein at least one of the plurality of lateral wall sections is to be partially positioned within a slot defined by the adjacent spine element in a substantially spring like manner in the transverse direction, and wherein the latching mechanism further comprises a first latching device and a second latching device that intermesh in a form-fit in the longitudinal direction.

25. An album comprising:

a first spine element;

a second spine element that is substantially similar to the first spine element, wherein the first spine element is adjacent and removably coupled to the second spine element to form an album spine, wherein the first spine element and the second spine element each include a binding gap positioned toward an interior of the album to receive and couple an edge of at least one album sheet to the respective spine element, wherein each of the first spine element and the second spine element is provided with a latching mechanism that comprises a plurality of lateral wall sections, wherein at least one of the plurality of lateral wall sections is to be partially positioned within a slot defined by the adjacent spine element in a substantially spring like manner in the transverse direction, and wherein the latching mechanism further comprises a first latching device and a second latching device that intermesh in a form-fit in the longitudinal direction, wherein the latching mechanism further comprises a positioning peg formed on a first lateral surface of the first spine element that corresponds to an elongated recess defined by a second lateral surface of the second spine element.

26. The album as defined in claim 25, wherein the latching mechanism further comprises a biasing element on the first lateral surface of the first spine element opposite the positioning peg and a step on the second lateral surface of the second spine element opposite the elongated recess, wherein the biasing element is to removably engage the step.

27. The album as defined in claim 26, wherein the first latching device and the second latching device intermesh in a direction of rotation and wherein the first spine element and the second spine element longitudinally shift relative to one another to intermesh the first latching device and the second latching device.

28. The claim as defined in claim 27, wherein the first spine element and the second spine element longitudinally shift against a force exerted by the biasing element.

29. The claim as defined in claim 28, wherein the biasing element includes a protrusion that extends beyond the respective spine element to pivot and disengage the biasing element from the step.

30. The claim as defined in claim 29, wherein the protrusion is externally accessible and recessed to an interior of the album relative to an outer edge of a plurality of cover elements.

* * * * *